US006834173B2

(12) United States Patent
Yamaguchi et al.

(10) Patent No.: US 6,834,173 B2
(45) Date of Patent: Dec. 21, 2004

(54) IMAGE-FORMING-APPARATUS PROCESS CARTRIDGE HAVING A LOCKING PORTION TO PREVENT THE CARTRIDGE FROM DISENGAGING FROM THE IMAGE FORMING APPARATUS AND AN IMAGE FORMING APPARATUS MOUNTING SUCH A CARTRIDGE

(75) Inventors: Koji Yamaguchi, Numazu (JP); Tatsuya Shiratori, Yokohama (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/179,847

(22) Filed: Jun. 26, 2002

(65) Prior Publication Data

US 2003/0086723 A1 May 8, 2003

(30) Foreign Application Priority Data

Nov. 5, 2001 (JP) ..... 2001-339244

(51) Int. Cl.[7] ..... G03G 15/08
(52) U.S. Cl. ..... 399/119; 399/227
(58) Field of Search ..... 399/119, 226, 399/227

(56) References Cited

U.S. PATENT DOCUMENTS

| | | | | |
|---|---|---|---|---|
| 4,743,938 A | | 5/1988 | Ohno | 355/3 |
| 5,021,825 A | * | 6/1991 | Niki | 399/111 |
| 5,066,976 A | | 11/1991 | Kanagawa et al. | 355/200 |
| 5,331,390 A | * | 7/1994 | Kimura et al. | 399/227 |
| 5,418,601 A | | 5/1995 | Fujisawa et al. | 355/200 |
| 5,729,796 A | | 3/1998 | Miura et al. | 399/114 |
| 5,734,949 A | * | 3/1998 | Goto et al. | 399/111 |
| 5,768,658 A | | 6/1998 | Watanabe et al. | 399/111 |
| 5,794,103 A | * | 8/1998 | Oh | 399/119 |
| 5,815,644 A | | 9/1998 | Nishiuwatoko et al. | 399/113 |
| 5,870,655 A | | 2/1999 | Nishiuwatoko et al. | 399/111 |
| 5,893,006 A | | 4/1999 | Kanno et al. | 399/13 |
| 5,926,666 A | | 7/1999 | Miura et al. | 399/25 |
| 5,937,240 A | | 8/1999 | Kanno et al. | 399/111 |
| 5,940,657 A | | 8/1999 | Yokomori et al. | 399/119 |
| 5,950,049 A | | 9/1999 | Yokomori et al. | 399/119 |
| 6,070,029 A | | 5/2000 | Nishiuwatoko et al. | 399/111 |
| 6,072,969 A | | 6/2000 | Yokomori et al. | 399/119 |
| 6,115,571 A | * | 9/2000 | Kobayashi | 399/119 |
| 6,141,508 A | | 10/2000 | Sasaki et al. | 399/27 |
| 6,345,164 B1 | | 2/2002 | Yokomori et al. | 399/119 |
| 6,381,430 B1 | | 4/2002 | Yokomori et al. | 399/119 |
| 6,418,296 B1 | * | 7/2002 | Aizawa et al. | 399/227 |
| 6,535,705 B2 | * | 3/2003 | Asakura et al. | 399/119 |

FOREIGN PATENT DOCUMENTS

| | | |
|---|---|---|
| JP | 62-127850 | 6/1987 |
| JP | 3-269440 | 12/1991 |
| JP | 7-295381 | 11/1995 |
| JP | 8-328448 | 12/1996 |

* cited by examiner

*Primary Examiner*—Fred Braun
(74) *Attorney, Agent, or Firm*—Fitzpatrick, Cella, Harper & Scinto

(57) ABSTRACT

A cartridge removably mountable to a main assembly of an electrophotographic image forming apparatus includes a developing member, a developer accommodating portion, a locking portion to engage a locking portion of the main assembly of the apparatus to prevent the cartridge from disengaging from the main assembly after mounting of the cartridge, a grip to be gripped by an operator when the cartridge is mounted to the main assembly, and a releasing portion to move the locking portion of the cartridge in interrelation with a movement of the grip which is moved when the operator grips the grip to disengage the cartridge from the main assembly of the apparatus. The locking between the locking portion of the cartridge and the locking portion of the main assembly is released by the movement of the locking portion of the cartridge.

22 Claims, 15 Drawing Sheets

A—A

IMAGE-FORMING-APPARATUS PROCESS CARTRIDGE HAVING A LOCKING PORTION TO PREVENT THE CARTRIDGE FROM DISENGAGING FROM THE IMAGE FORMING APPARATUS AND AN IMAGE FORMING APPARATUS MOUNTING SUCH A CARTRIDGE

BACKGROUND OF THE INVENTION

Field of the Invention and Related Art

The present invention relates to a cartridge, and an electrophotographic image forming apparatus employing a cartridge.

Here, an electrophotographic image forming apparatus is an apparatus for forming an image on a recording medium (for example, a recording paper, an OHP sheet, and the like) with the use of an electrophotographic image forming method. It includes an electrophotographic copying machine, an electrophotographic printer (a laser printer, an LED printer, and the like), a facsimile apparatus, a word processor, and the like.

A cartridge system has long been in use, according to which a developing member and a developer storage portion, for example, are integrated in the form of a cartridge which can be removably mountable in the main assembly of an image forming apparatus. Also according to a cartridge system, a developing member as a processing means can be easily maintained by a user him/herself, remarkably improving the operability of an image forming apparatus. Therefore, a cartridge system is widely used in the field of an electrophotographic image forming apparatus.

An electrophotographic color image forming apparatus employs a rotary device, which is disposed within the apparatus main assembly. Further, a structural arrangement has been known, which makes it possible to removably mount four development cartridges, in which four developers, different in color, are stored one for one, in this rotary device.

In the past, the following structural arrangement was devised to prevent a development cartridge from becoming dislodged from the rotary device when the rotary device is rotated.

For example, the end plates of the development cartridge are each provided with a projection, and the development cartridges are inserted into the apparatus main assembly so that these projections move along the corresponding guides on the rotary device side. Further, the end portion of each guide is provided with a spring enabled to catch the projection, so that the cartridge is held to the rotary device by the force generated by the resiliency of the spring. In the case of this structural arrangement, however, in order to ensure that a cartridge does not become dislodged from the rotary device due to the centrifugal force generated as the rotary device is rotated, the force generated by the resiliency of the spring must be substantial; in other words, the spring must be stiff enough to generate such a force. Providing the end portion of the guide with a spring stiff enough to generate such a force increases the load generated when a cartridge is mounted into, or dismounted from, the rotary device. Further, when mounting or dismounting a cartridge, the left and right springs are likely to become disengaged non-simultaneously from the cartridge, making it possible that the cartridge will become tilted and hang up in the rotary device. On the other hand, reducing the stiffness of the spring to reduce the cartridge retaining force of the spring makes it possible for a cartridge to fall out of the rotary device and damage the apparatus main assembly. Thus, the spring must be made neither too stiff nor too soft so that a proper amount of force is generated by the resiliency of the spring.

SUMMARY OF THE INVENTION

The primary object of the present invention is to provide a combination of a cartridge and an electrophotographic image forming apparatus, in which the cartridge can be more efficiently mounted into, or dismounted from, the main assembly of an image forming apparatus.

Another object of the present invention is to provide a combination of a cartridge and an electrophotographic image forming apparatus, in which the cartridge does not become unexpectedly dislodged from the main assembly of an image forming apparatus after the mounting of the cartridge into the apparatus main assembly.

Another object of the present invention is to provide a combination of a cartridge and an electrophotographic image forming apparatus, which ensures that the cartridge is placed in a predetermined position in the main assembly of an image forming apparatus as the cartridge is mounted into the image forming apparatus main assembly, and that cartridge remains in the predetermined position after the mounting.

Another object of the present invention is to provide a combination of a cartridge and an electrophotographic image forming apparatus, in which the cartridge does not become unexpectedly dislodged from a rotary device as the rotary device is rotated after the mounting of the cartridge into the rotary device, that is, a part of the image forming apparatus main assembly.

Another object of the present invention is to provide a combination of a cartridge and an electrophotographic image forming apparatus, in which as an operator releases his or her hand from the handgrip of the cartridge, which has been grasped by the operator in order to mount the cartridge into the main assembly of the image forming apparatus, the cartridge locking portion of the cartridge engages the cartridge locking portion of the main assembly of the image forming apparatus.

Another object of the present invention is to provide a combination of a cartridge and an electrophotographic image forming apparatus, in which as an operator grasps the handgrip of the cartridge in order to dismount the cartridge from the main assembly of the image forming apparatus, the cartridge locking portion of the cartridge disengages from the cartridge locking portion of the main assembly of the image forming apparatus.

Another object of the present invention is to provide a combination of a cartridge and an electrophotographic image forming apparatus, in which the mounting or dismounting of the cartridge is instinctively understandable to an operator, and the cartridge is smoothly mountable into, or dismountable from, the main assembly of the image forming apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to a development cartridge as an example of a cartridge.

Embodiment 1

A development cartridge in accordance with the present invention, and an electrophotographic image forming apparatus compatible with such a development cartridge, will be described with reference to the appended drawings. In the following description of the preferred embodiments of the present invention, the front side is the upstream side in terms of the direction in which a recording medium is conveyed from the transfer station to the fixation station (right side in FIG. 1). The left or right side of the apparatus main assembly or cartridge is the left or right side as seen from the front side of the apparatus. Further, the lengthwise direction is the direction which is parallel to the surface of a recording medium, and perpendicular (virtually perpendicular) to the direction in which the recording medium is conveyed.

General Structure of Image Forming Apparatus

Figure 1:
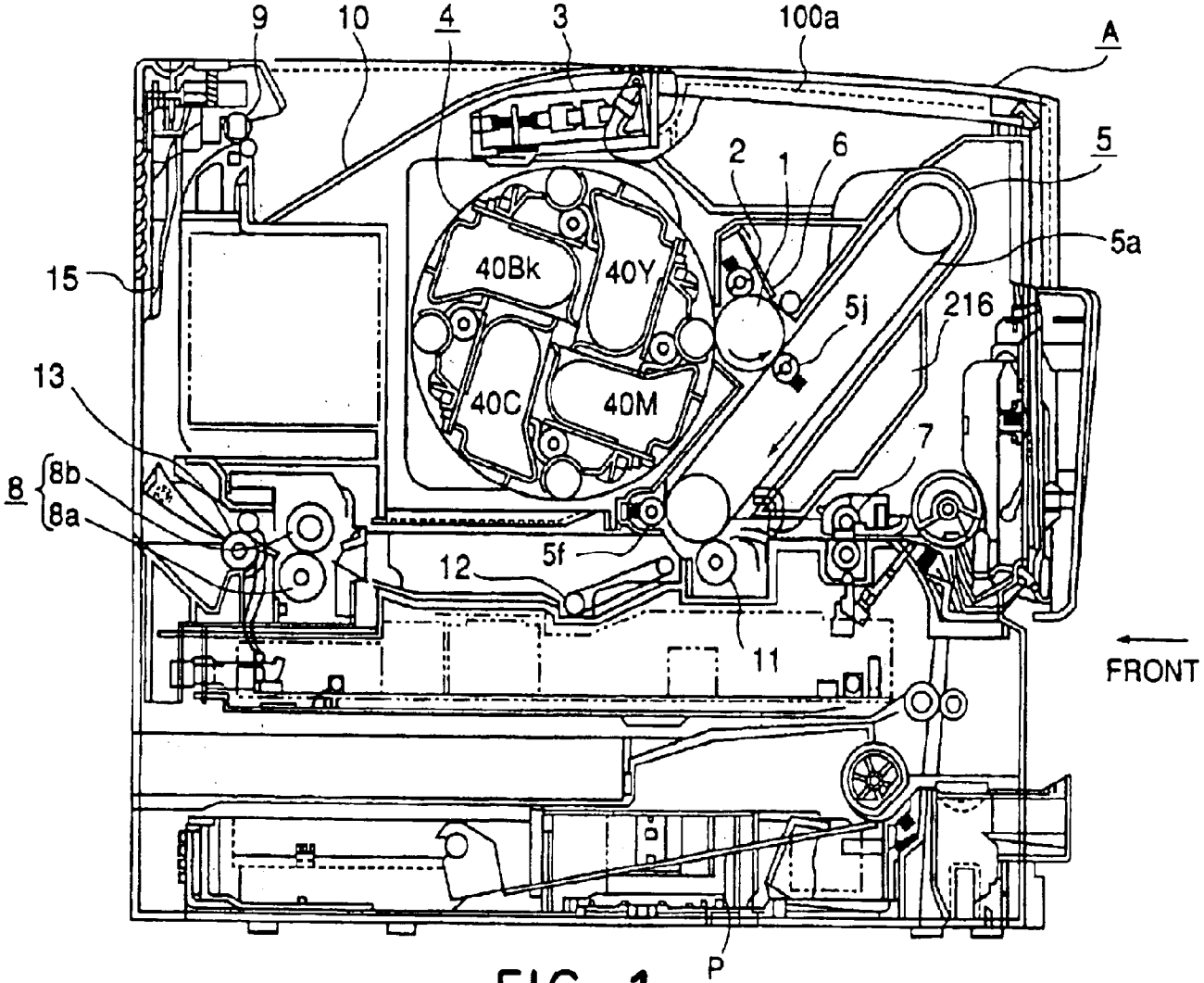
FIG. 1 is a sectional view of an image forming apparatus in accordance with the present invention, for depicting the general structure thereof.

First, referring to FIG. 1, the general structure of an electrophotographic color image forming apparatus will be described. FIG. 1 shows the general structure of a color laser beam printer, as an example of an image forming apparatus, in the main assembly 100*a* of which a development cartridge, a process cartridge, and an intermediary transfer unit have been mounted.

In the image forming apparatus shown in FIG. 1, an optical image in accordance with image formation data is projected from an exposing means 3 onto an electrophotographic photoconductive member in the form of a drum (which hereinafter will be referred to as a photoconductive drum). Then, a latent image formed on the photoconductive drum 1 is developed by a developing member, (which hereinafter will be referred to as development roller 305). Meanwhile, a recording medium P is conveyed by a conveying means, in synchronism with the formation of the developer image on the drum 1 by the development roller 305, and the developer image is transferred onto an intermediary transfer medium 5*a*. Next, the developer image on the intermediary transfer medium member 5*a* is transferred by a second transferring means onto the recording medium P. Then, the recording medium P is conveyed into a fixing device 8 having a pressure roller 8*a* and a heat roller 8*b*. In the fixing device 8, the developer image on the recording medium P is fixed to the recording medium P. Then, the recording medium P is discharged into a delivery portion 10 by a discharge roller pair 9.

Here, the recording medium P is a recording paper, an OHP sheet, and the like, for example. The developing member is not limited to the development roller; for example, it may be in the form of a belt.

Next, the image forming processes will be described in more detail.

The photoconductive drum 1 is rotated in the direction (counterclockwise) of the arrow mark in FIG. 1 in synchronism with the rotation of the transfer belt 5*a*, and the peripheral surface of the photoconductive drum 1 is uniformly charged by the charge roller 2. Then, the peripheral surface of the photoconductive drum 1 is exposed by the exposing means 3; it is exposed to the optical image of the yellow color component, for example, of an intended image. As a result, an electrostatic latent image corresponding to the yellow color component of the intended image is formed on the peripheral surface of the photoconductive drum 1.

The exposing process is carried out as follows: the exposing means 3 exposes the peripheral surface of the photoconductive drum 1 to an optical image in accordance with the image formation data read from an external apparatus or the like, by projecting the optical image onto the photoconductive drum 1. It comprises a laser diode, a polygon mirror, a scanner motor, a focusing lens, and a deflection mirror.

As image signals are given to the exposing means 3 from an external device or the like, the laser diode emits light in accordance with the image signals, and the light is projected as the optical image toward the polygon mirror which is being rotated at a high speed by the motor. The optical image is deflected by the polygon mirror, passed through the focusing lens, deflected by the deflection mirror, and selectively exposes the peripheral surface of the photoconductive drum 1. As a result, an electrostatic latent image is formed on the photoconductive drum 1. Upon formation of the electrostatic latent image, the rotary device 4 is rotated so that the development cartridge 40, and more specifically, the cartridge 40Y for developing the yellow component of the intended image, is moved to the development position. Then, a predetermined bias voltage is applied to the cartridge 40Y. As a result, yellow toner is adhered to the electrostatic image; and the electrostatic latent image is developed. Thereafter, a bias voltage, the polarity of which is opposite to that of the toner, is applied to the primary transfer roller 5*j* for the transfer belt 5*a*. As a result, the yellow toner image on the photoconductive drum 1 is transferred (primary transfer) onto the transfer belt 5*a*.

As the above described primary transfer of the yellow toner image is completed, the rotary device 4 is rotated again, moving the next cartridge 40 into the position in which the cartridge 40 opposes the photoconductive drum 1. The above-described process is also repeated for the magenta, cyan, and black color components. As a result, four color developer images, different in color, are placed in layers on the transfer belt 5*a*. Meanwhile, the secondary transfer roller 11 remains in out of contact with the intermediary transfer belt 5*a*, and a cleaning charge roller 5*f* as a cleaning unit is kept at a location at which it does not contact the transfer belt 5*a*.

Incidentally, the magenta development cartridge 40M has a development roller 305, and a developer storage portion 302 which contains developer of magenta color. Similarly, the cyan development cartridge 40C has a development roller 305, and a developer storage portion 302 which contains developer of cyan color, and the yellow development cartridge 40Y has a development roller 305, and a developer storage portion 302 which contains developer of yellow color. Further, the black cartridge 40Bk has a development roller 305, and a developer storage portion 302 which contains developer of black color.

After the formation of the four color developer images, different in color, on the transfer belt 5*a*, the transfer roller 11 is pressed against the transfer belt 5*a* as shown in FIG. 1. Further, in synchronism with the pressing of the transfer roller 11 against the transfer belt 5*a*, a recording medium P, which has been kept on standby at a registration roller pair 7, is released to be sent into the nip portion between the transfer belt 5*a* and transfer roller 11. To the transfer roller 11, a bias voltage, the polarity of which is opposite to that of the developer, is being applied, and the developer images on the transfer belt 5*a* are transferred (secondary transfer) all at once onto the surface of the recording medium P as the recording medium P is conveyed into the aforementioned nip portion. After the transfer of the developer images, the recording medium P is conveyed by a conveyer belt unit 12 to the fixing device 8, in which the developer images are fixed. Thereafter, the recording medium P is conveyed along the guide 15 by a roller pair 13, and is discharged into a delivery tray 10.

Figure 8:
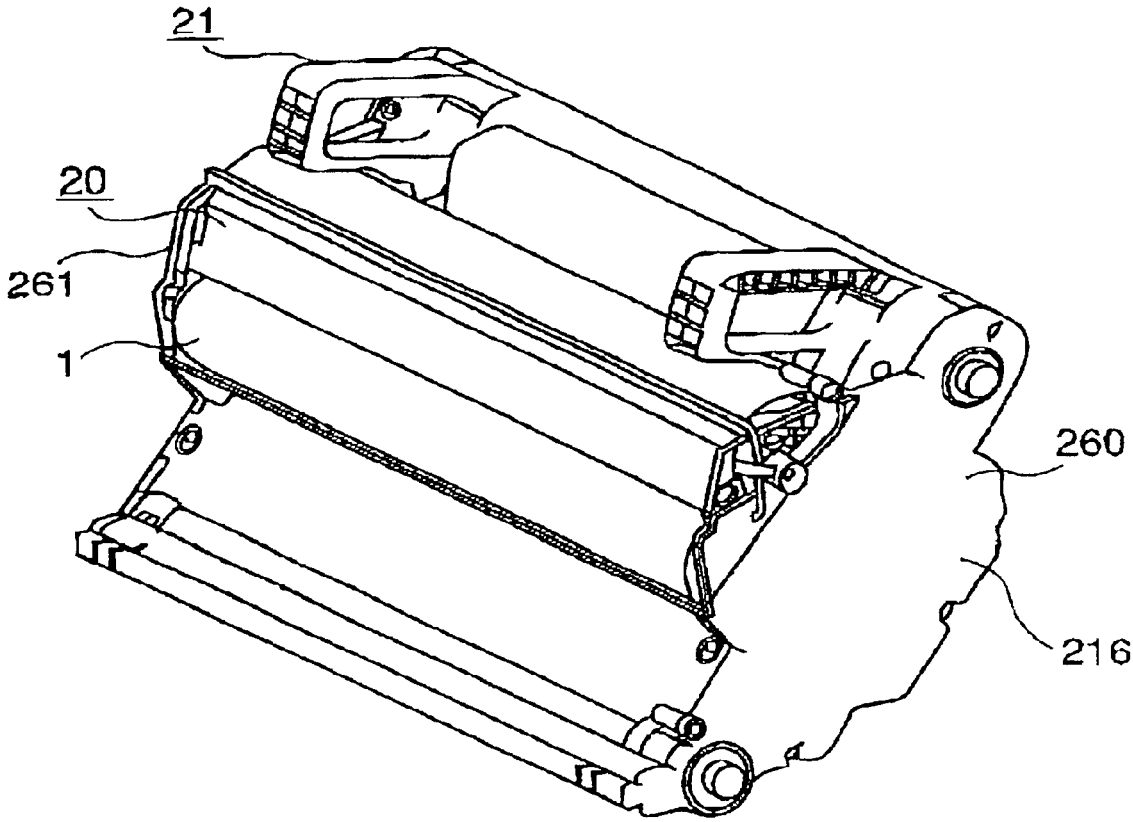
FIG. 8 is a perspective view of a process cartridge, as seen from the left side.

Meanwhile, after the completion of the secondary transfer, the cleaning charge roller 5*f* is pressed against the transfer belt 5*a*, and a predetermined bias voltage is applied to the cleaning charge roller 5*f*, removing residual electrical charge from the surface of the transfer belt 5*a*, and the developer particles (secondary residual developer particles) remaining on the transfer belt 5*a*. After the removal of electrical charge, the residual developer particles are electrostatically transferred back onto the photoconductive drum 1 from the transfer belt 5*a*, in the primary transfer nip portion; in other words, the surface of the transfer belt 5*a* is cleaned. After being transferred back onto the photoconductive drum 1, the secondary transfer residual developer particles are removed (recovered) by the cleaning blade 6 for cleaning the photoconductive drum 1. The recovered transfer residual developer particles are collected in the removed developer box 216 (FIG. 8).

(Structural Arrangement for Mounting or Dismounting Development Cartridge)

Figure 2:
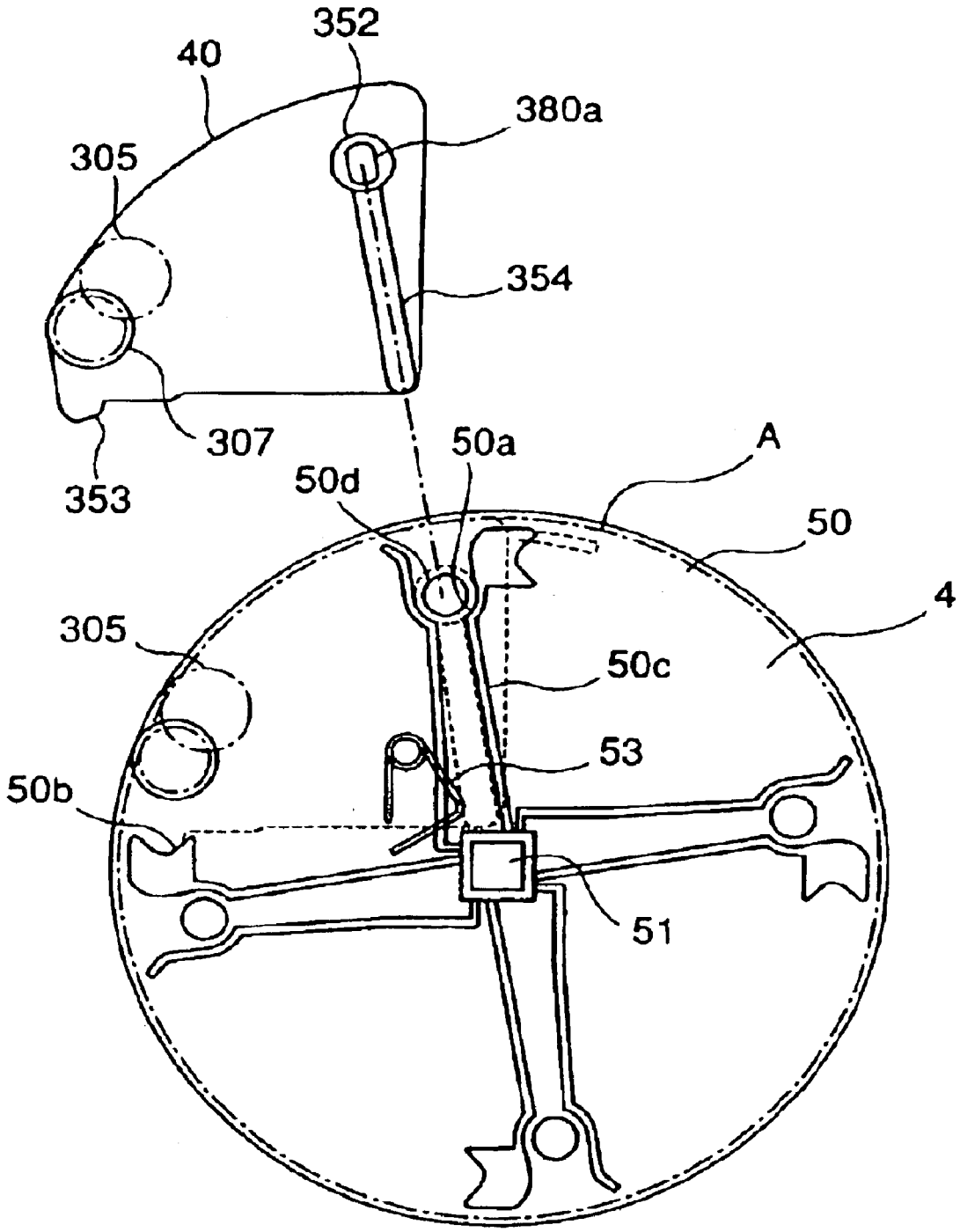
FIG. 2 is side view of a rotary device and a development cartridge, for showing how the development cartridge is mounted into the rotary device.
Figure 3:
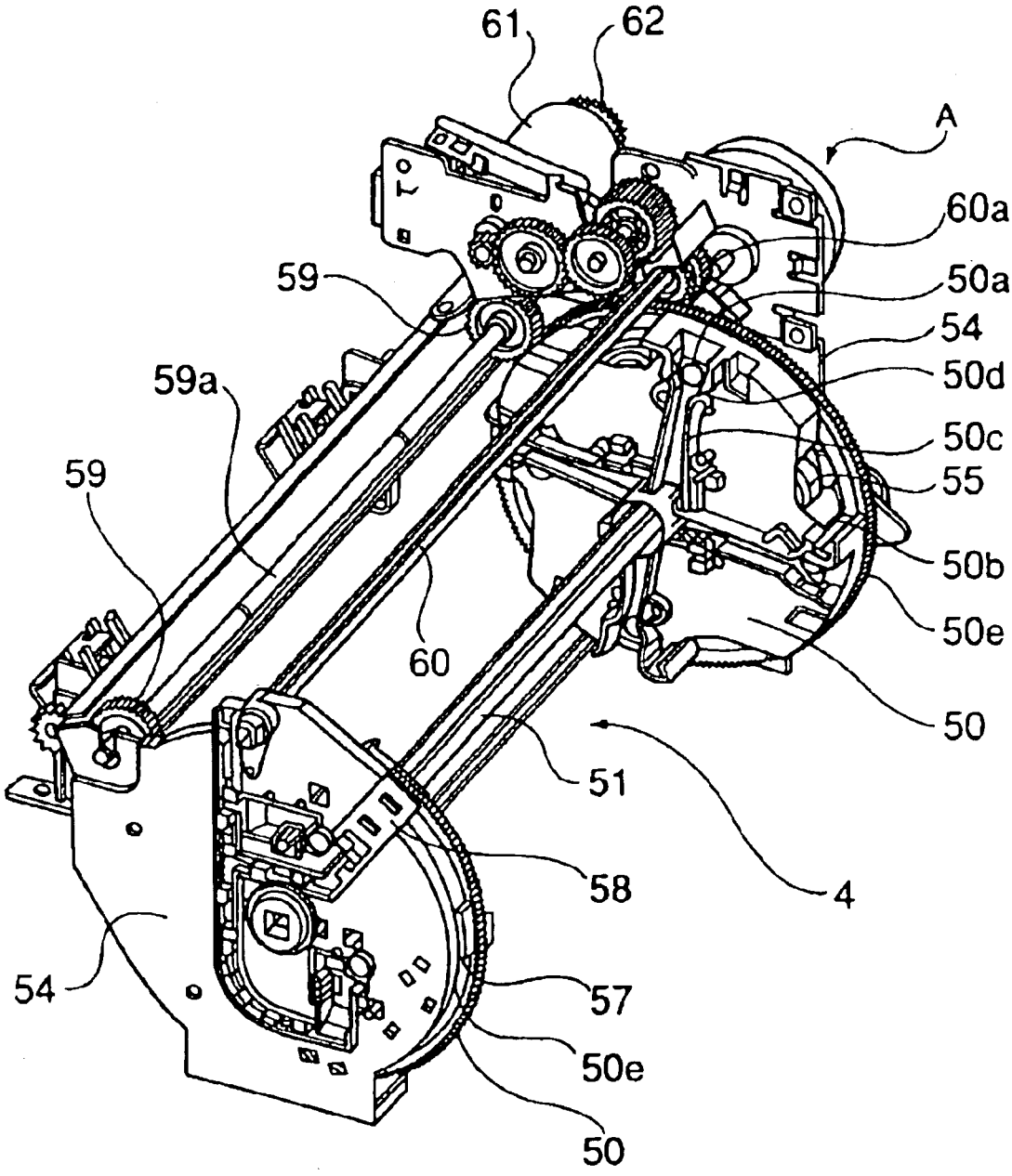
FIG. 3 is a perspective view of a rotary device.
Figure 4:
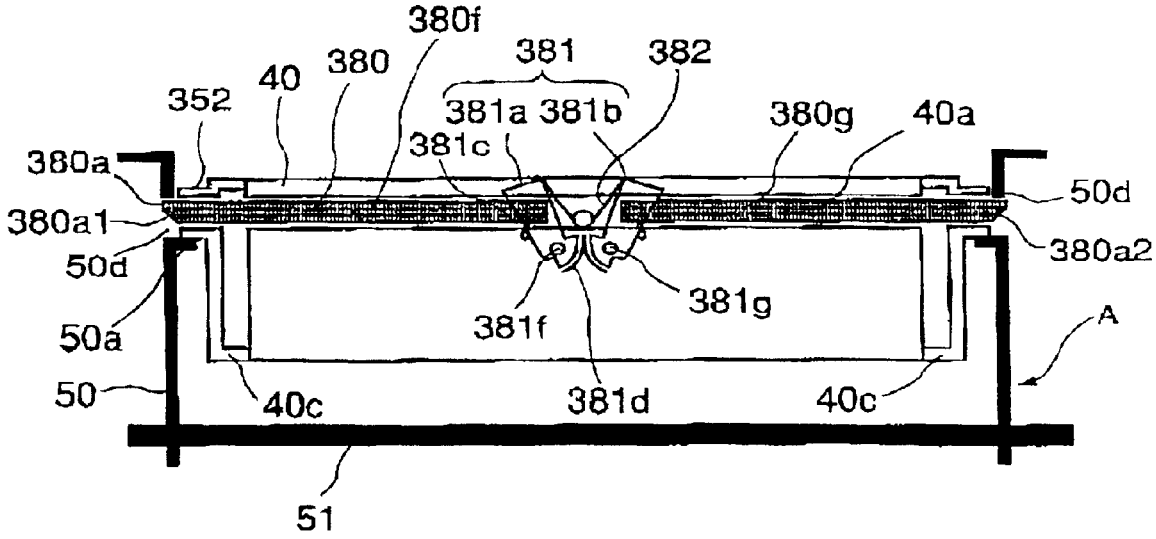
FIG. 4 is a sectional view of a combination of a rotary device and a development cartridge, at a plane parallel to the front panel of an image forming apparatus, for showing how the development cartridge is mounted into the rotary device.
Figure 5:
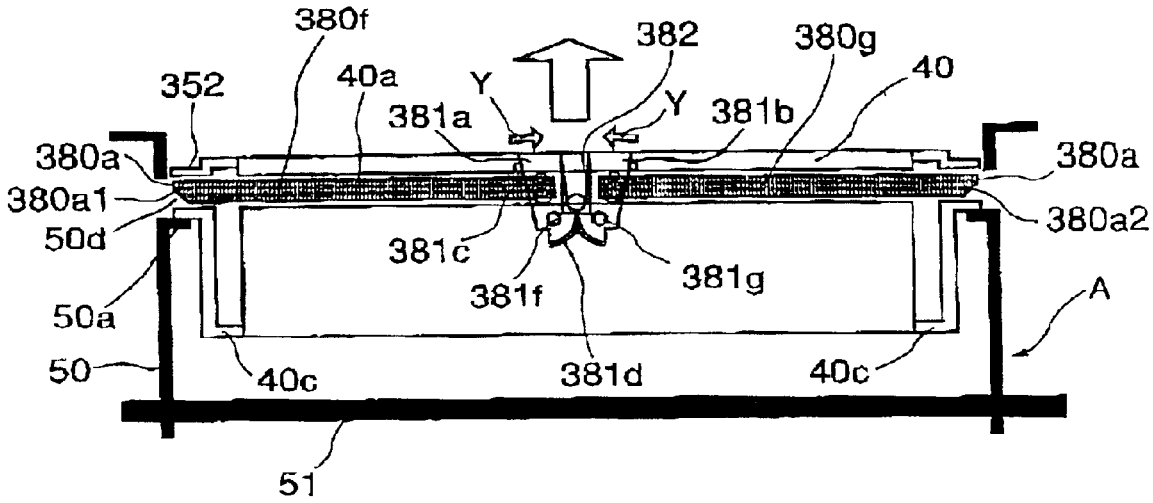
FIG. 5 is a sectional view of a combination of a rotary device and a development cartridge, at a plane parallel to the front panel of an image forming apparatus, for showing how the development cartridge is dismounted from the rotary device.
Figure 9:
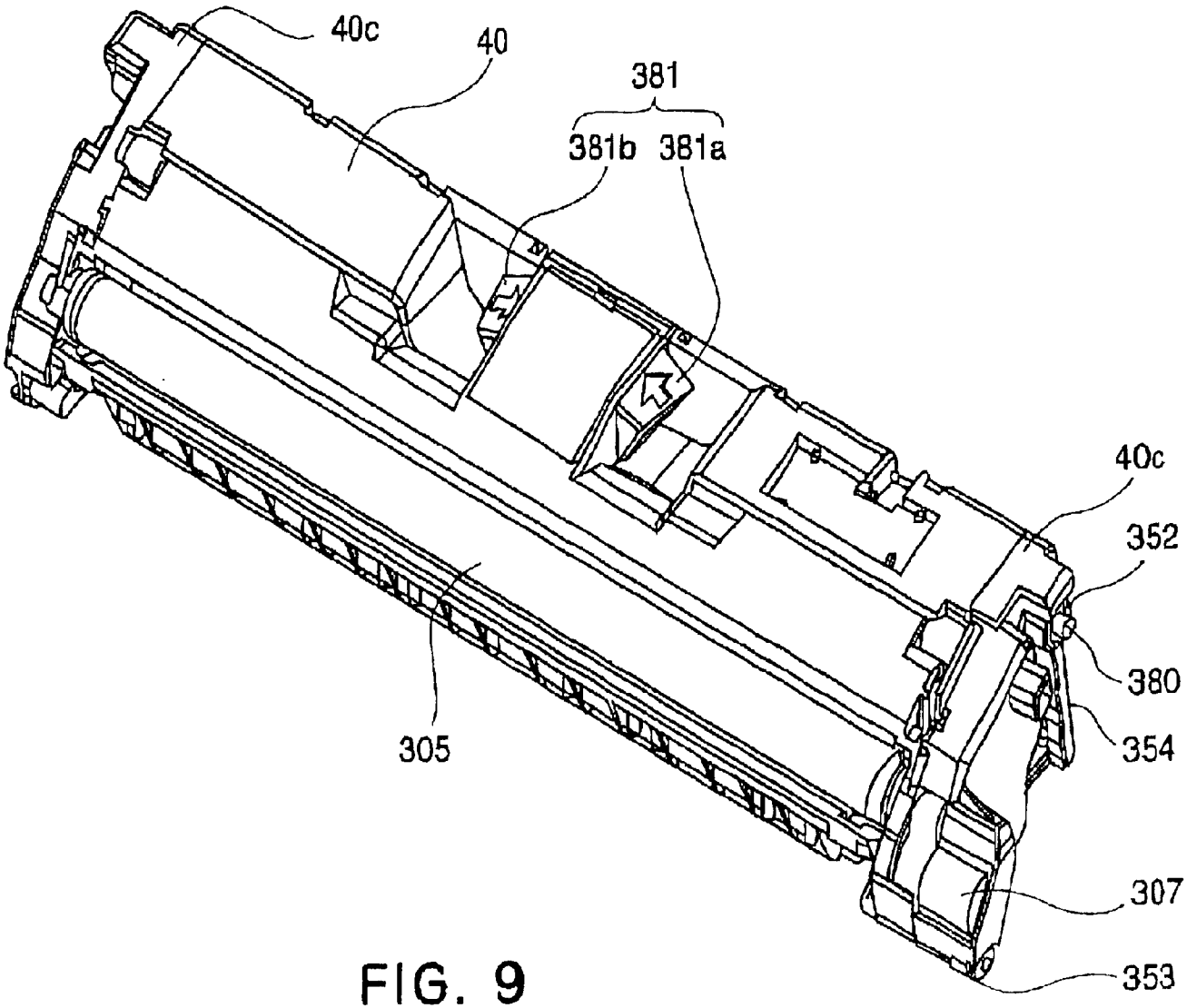
FIG. 9 is a perspective view of a development cartridge.
Figure 10:
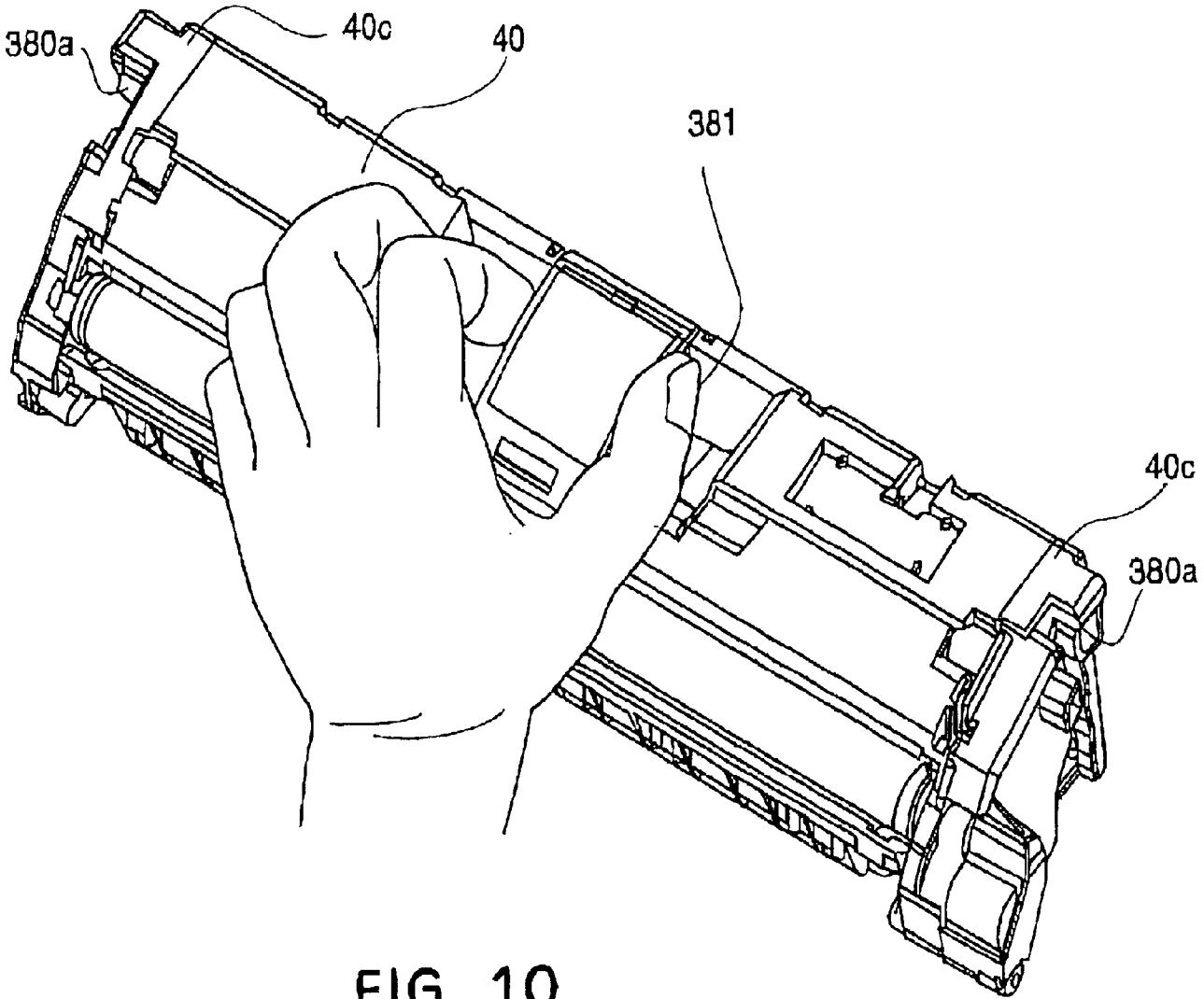
FIG. 10 is a perspective view of a development cartridge, and a hand grasping the handgrip of the development cartridge.
Figure 11:
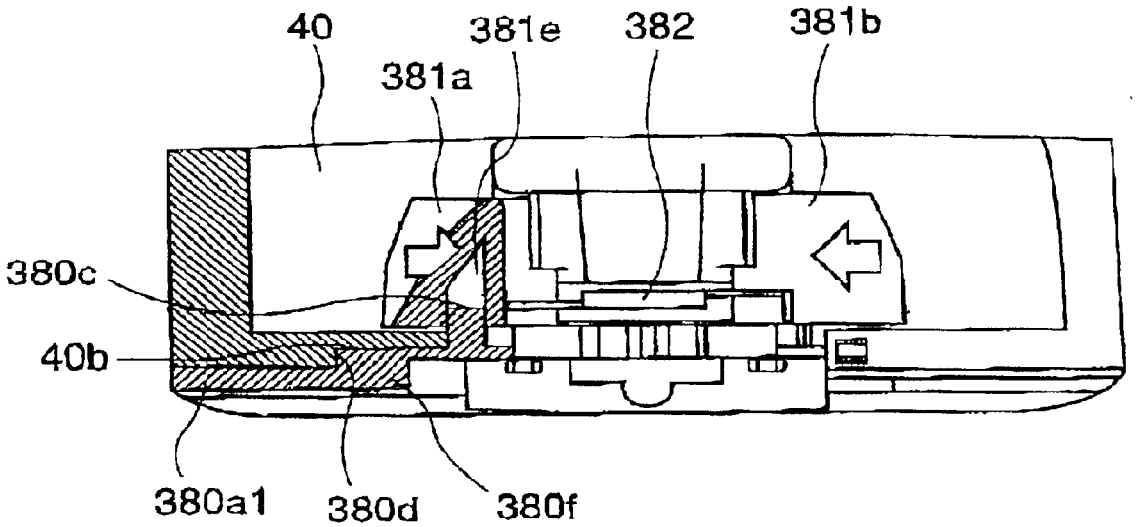
FIG. 11 is a detailed drawing (partially broken away view) of the handgrip of a development cartridge, and the components associated with the handgrip.
Figure 12:
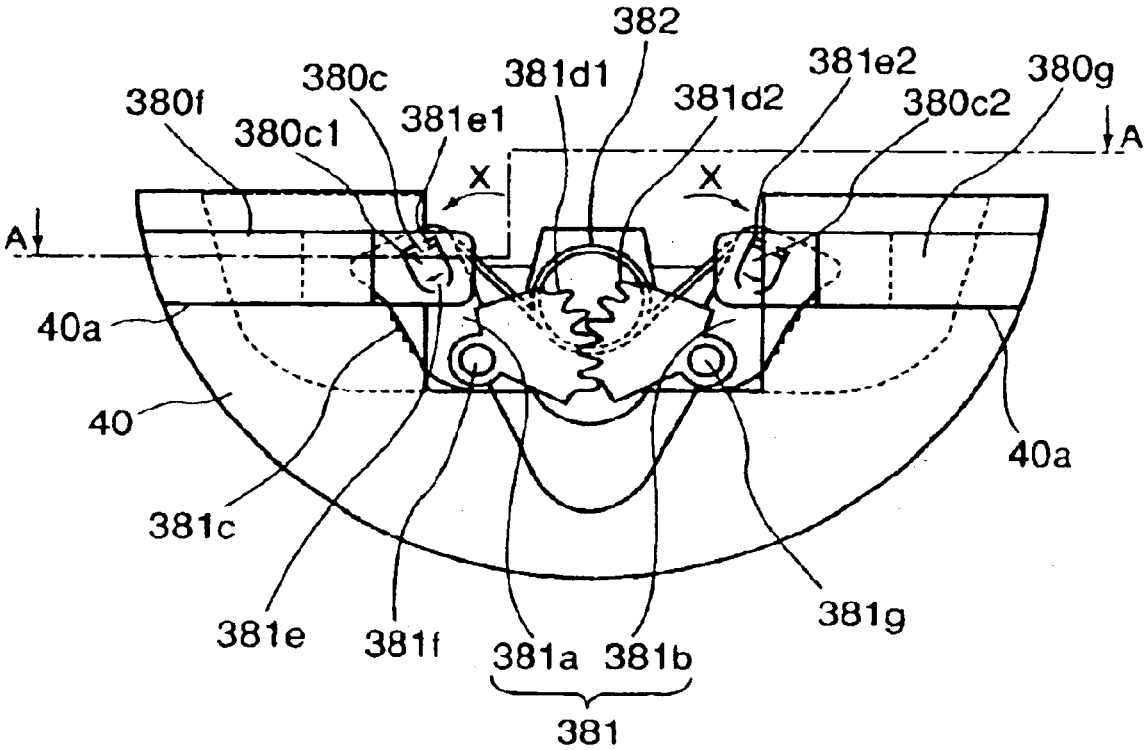
FIG. 12 is a sectional view of the handgrip of the development cartridge, and the components associated with the handgrip, at a plane A—A in FIG. 11.

The development cartridge 40 (40Bk, 40M, 40C and 40Y), which contains color developer (black, magenta, cyan and yellow, respectively) is mounted into a predetermined position in the rotary device. Here, the method for positioning the cartridge 40 relative to the rotary device 4 will be described in detail with reference to FIGS. 2–4, and 9–11. FIG. 2 is a side view of the rotary device 4 and one of the cartridge 40, for showing how the cartridge 40 is mounted into the rotary device 4, and FIG. 3 is a perspective view of the rotary device 4. FIG. 4 is a sectional view of a combination of the rotary device 4 and cartridge 40, at a plane parallel to the front panel of an image forming apparatus, for showing how the cartridge 40 is mounted into the rotary device 4, and FIG. 5 is a sectional view of the combination of the rotary device 4 and cartridge 40, at a plane parallel to the front panel of an image forming apparatus, for showing how the cartridge 40 is dismounted from the rotary device 4. Further, FIG. 9 is a perspective view of the cartridge 40, and FIG. 10 is a perspective view of the cartridge 40, and a hand grasping the handgrip of the cartridge 40. FIG. 11 is a detailed drawing (partially broken away view) of the handgrip portion of the cartridge 40, and FIG. 12 is a sectional view of the handgrip of the development cartridge, and the components associated with the handgrip, at a plane A—A in FIG. 11.

Referring to FIG. 3, the rotary device 4 rotates about a center shaft 51. To each of the lengthwise ends of the center shaft 51, a rotary flange 50 in the form of a disc is solidly attached. The flange 50 is provided with: guiding grooves 50*c* for guiding the cartridge 40 when the cartridge 40 is mounted or dismounted; first cartridge catching portions 50*a*, relative to the axial line with respect to which the cartridge is positioned; and second cartridge catching portion 50*b* for stopping the rotation of the cartridge 40. The cartridge catching portion 50*a* is provided with a cartridge locking portion 50*d* (which hereinafter will be referred to as hole 50*d*), which is in the surface perpendicular to the lengthwise direction, and the axial line of which coincides with that of the first cartridge catching portion 50*a*. This hole 50*d* serves as a locking hole for preventing the dislodgment of the cartridge 40.

In comparison, each of the left and right ends of the cartridge 40 is provided with: a guiding rib 354 for guiding the cartridge 40 when the cartridge 40 is mounted or dismounted; an arcuate positioning portion 352 (which hereinafter will be referred to as a first projection 352) for positioning the cartridge 40 relative to the apparatus main assembly A, as the cartridge 40 is mounted into the apparatus main assembly A; and a second arcuate projection 353 for stopping the rotation of the cartridge 40. Thus, the cartridge 40 is positioned relative to the apparatus main assembly A by the coordination of the first and second projections 352 and 353.

The cartridge 40 is provided with a retractable locking portion 380*a* (which hereinafter will be referred to as movable locking portion 380*a*), which protrudes in the lengthwise direction of the cartridge 40, more specifically, from the end surface of the projection 352. This locking portion 380*a* is attached to the end of a releasing member 380 (which hereinafter may be referred to as sliding member 380). To describe this feature in more detail with reference to FIG. 4, the sliding member 380 has a first releasing portion 380*f* (which hereinafter will be referred to as a first sliding portion 380*f*), the length of which is half the length of the cartridge 40, and a second releasing portion 380*g*

(which hereinafter will be referred to as a second sliding portion 380*g*). The first and second sliding portions 380*f* and 380*g* are provided with first and second locking portions (which hereinafter will be referred to as first and second locking portions 380*a*1 and 380*a*2), which are located at the ends of the sliding portions 380*f* and 380*g*, respectively.

As the sliding member 380 is slid, the locking portion 380*a* (380*a*1, 380*a*2) projects or retracts from the end surface (end surface of cartridge frame 40*c*) of the projection 352. Further, the cartridge 40 is provided with a handgrip portion 381 (which hereinafter will be referred to as a handgrip 381), which is located at the approximate center of the top surface of the cartridge 40. This handgrip 381 is always kept pressured by the resiliency of a torsion coil spring 382 in the direction to open upward (direction indicated by arrow mark X in FIG. 12). The sliding member 380 is in the form of a rod, which slides in the guiding groove 40*a* in the back side of the cartridge 40. The handgrip 381 is a part of the releasing member 380.

The guiding groove 40*a* is provided with a stepped portion 40*b*, whereas the sliding member 380 is provided with a stepped portion 380*d*. The stepped portions 40*b* and 380*d* limit the moving range of the sliding member 380 (380*f*, 380*g*); the contact between the stepped portions 40*b* and 380*d* stops the outward sliding of the sliding member 380, preventing the sliding member 380 (380*f*, 380*g*) from slipping out of the groove 40*a* (FIG. 11). Incidentally, FIG. 11 shows only the sliding portion 380*f*.

The handgrip 381 has left and right portions, that is, a first handgrip portion 381*a* and a second handgrip portion 381*b* (which hereinafter will be referred to as handgrip portions 381*a* and 381*b*, respectively). The pair of handgrip portions 381*a* and 381*b* are connected to the above described sliding members 380. Thus, as an operator performs the operation for releasing or locking the cartridge 40, that is, as an operator grasps or releases the handgrip 381, the sliding member 380 slides.

More specifically, the handgrip portions 381*a* and 381*b* are each provided with an elongated hole 381*e*, which is in their side walls. On the other hand, the sliding member 380 is provided with a projection 380*c*, which is at the lengthwise end opposite to the projection 380*a*. The projection 380*c* is in the elongated hole 381*e* (FIG. 11). With the provision of the above described structural arrangement, as the handgrip 381 is gripped or released, the sliding member 380 slides.

In other words, the handgrip 381 has a portion 381 a rotatable about a shaft 381*f*, and a portion 381*b* rotatable about a shaft 381*g*. The portion 381*a* has a gear portion 381*d*1, and portion 381*b* has a gear portion 381*d*2. The gear portions 381*d*1 and 381*d*2 are in meshing engagement with each other. The handgrip portion 381*a* is provided with an elongated hole 381*e*1, and the first sliding portion 380*f* is provided with a projection 380*c*1, which is fitted in the elongated hole 381*e*1. Similarly, the handgrip portion 381*b* is provided with an elongated hole 381*e*2, and the second sliding portion 380*g* is provided with a projection 380*c*2, which is fitted in the elongated hole 381*e*2. Further, between the handgrip portions 381*a* and 381*b*, a torsion coil spring 382 is disposed, with its resiliency keeping the handgrip portions 381*a* and 381*b* pressured in the direction to move them away from each other, that is, the direction indicated by arrow marks X in FIG. 12. Thus, normally, the locking portions 380*a* (380*a*1, 380*a*2) at the ends of the sliding portions 380*f* and 380*g*, one for one, remain protruding from the cartridge frame 40*c* of the cartridge 40. However, as an operator grasps the handgrip 381 in a manner to press the handgrip portions 381*a* and 381*b* (FIG. 10), the handgrip portions 381*a* and 381*b* rotate in the direction (indicated by arrow marks Y in FIG. 5) opposite to the direction indicated by the arrow marks X against the resiliency of the spring 382, causing the locking portions 380*a* to retract into the frame 40*c*.

In the normal state, the handgrip 381 is under the pressure generated by the resiliency of the torsion coil spring 382, remaining therefore open. Thus, the locking portions 380*a* (380*a*1, 380*a*2) of the sliding members 380 (380*f*, 380*g*) remain protruding from the end surfaces of the projections 352, that is, the end surfaces of the cartridge frame 40*c*. As an operator grasps the handgrip 381, the hinge closes, causing the projections 380*a* to retract completely into the projection 352.

In order to prevent the cartridge 40 from slipping out of the hand of an operator when the operator is carrying the cartridge 40 by grasping the handgrip 381, the handgrip 381 is provided with a plurality of slip prevention ribs 381*c*, which are 0.5 mm high and are on the surfaces on which the hand is placed. Further, the handgrip 381 is configured so that, with the handgrip portions 381*a* and 381*b* being in the main structure of the handgrip 381, that is, with the handgrip 381 being in the closed state, the surfaces on which the hand is placed, will be inward of the main structure.

Referring to FIG. 5, the handgrip portions 381*a* and 381*b* are provided with gear portions 381*d*1 and 381*d*2, respectively, the rotational axes of which coincide with those of the handgrip portions 381*a* and 381*b*, respectively, and which are on the sides opposite to the surfaces, on which the operator's hand is placed. The gear portions 381*d*1 and 381*d*2 of the handgrip portions 381*a* and 381*b*, respectively, are meshed with each other. Therefore, even when only one of the handgrip portions, for example, the handgrip portion 381*a* (381*b*), is retracted, the other, that is, the handgrip portion 381*b* (381*a*), is also retracted, causing both sliding portions 380*f* and 380*g* to simultaneously operate. With the provision of this structural arrangement, it does not occur that only one lengthwise end of the cartridge 40 hangs up in the rotary flange 50, or becomes dislodged from the rotary flange 50. As described above, the cartridge 40 is structured so that the left and right sliding portions 380*f* and 380*g* always move at the same time, ensuring that the cartridge 40 can be reliably mounted into, or dismounted from, the apparatus main assembly (rotary device 4).

When inserting the cartridge 40 into the rotary device 4, first, an operator is to grasp the handgrip 381, and insert the cartridge 40, with the guiding ribs 354 on both lengthwise end surfaces, one for one, fitted in the guiding groove 50*c* of the flanges 50, one for one. Then, as the projection 352 on each of the lengthwise surfaces of the cartridge 40 comes into contact with the first cartridge catching portion 50*a* on the side surface of the flange 50, the operator is to remove the hand that is grasping the handgrip 381, from the handgrip 381, allowing the projection 380*a* to project beyond the end surface of the projection 352, and latch into the hole 50*d* in the lengthwise end surface of the first cartridge catching portion 50*a* (FIG. 4).

The axial line of the projection 352 coincides with that of the projection 380*a*, making it possible for the cartridge 40 to pivot about the projection 352. Further, in the guiding groove 50*c*, a spring 53 is disposed, which is for keeping the cartridge 40 pressured in the counterclockwise direction of the drawing after the mounting of the cartridge 40 into the rotary device 4. Therefore, the second projection 353 is kept in contact with the cartridge catching portion 50*b* (rotary flange) by the resiliency of the spring 53. As a result, the cartridge 40 is kept accurately positioned relative to the apparatus main assembly A (rotary device 4); therefore, it is ensured that the cartridge 40 remains in the normal position relative to the flange 50, making it possible to form images with no irregularities.

On the other hand, when removing the cartridge 40 from the main assembly A (rotary device 4), the operator is to grasp the handgrip 381 as shown in FIGS. 5 and 10, causing the projections 380*a* (380*a*1, 380*a*2) to retract and come out of the holes 50*d*, allowing the cartridge 40 to be removed from the apparatus main assembly A (rotary device 4).

With the provision of the above described structural arrangement, the cartridge 40 can be unlocked from the apparatus main assembly A (rotary device 4) by the simple grasping of the handgrip 381 by the operator, improving the efficiency with which the cartridge 40 can be mounted or dismounted. Further, the provision of the above described structural arrangement eliminates the need for providing the apparatus main assembly A with springs or the like dedicated for preventing the dislodgment of the cartridge 40, virtually eliminating the load generated when the cartridge 40 is removed from the apparatus main assembly A. Further, the structural arrangement is simple, being therefore unlikely to fail, and also, making it possible to reduce the manufacturing cost.

Further, the handgrip 381 is located at the approximate center of the top surface of the cartridge 40 in terms of the lengthwise direction, reducing the load generated when the cartridge 40 is carried by the operator, as well as keeping the cartridge better balanced when the cartridge 40 is mounted or dismounted. Therefore, the operator can smoothly mount or dismount the cartridge 40 using only one hand.

Mechanical Structure for Driving Development Cartridge

Next, referring to FIG. 6, the mechanical structure for driving the cartridge 40 will be described. The rotary device 4 is provided with a pair of side plates 54, which are located on the outward sides of the rotary flanges 50, one for one. The center shaft 51 is put through the flanges 50 and the side plate 54; in other words, the flanges 50 and center shaft 51 are rotationally supported by the side plates 54. One of the side plates 54 is provided with a plurality of gears (gear train) which can be meshed with their counterparts. The driving force input gear 307 of the cartridge 40 meshes with the most downstream gear 55 of this gear train. The gear 307 rotationally drives the development roller 305, a coating roller, stirring members, and the like, by the driving force transmitted from the apparatus main assembly A.

In this embodiment, the cartridge 40 is orbitally moved through a predetermined angle by the rotation of the flanges 50, causing the gear 307 of the cartridges 40 to mesh with the gear 55. However, there is a possibility that when the cartridges 40 are orbitally moved by the rotation of the flanges 50, the tips of the teeth of the gears 55 will collide with those of the gear 307, and prevent the gears 55 and 307 from becoming properly meshed. The gears must be enabled to mesh with each other in such a case. Therefore, in this embodiment, a structural arrangement is provided so that after the initial engagement between the two gears 55 and 307, the cartridge 40 reversely pivots once about the axial line of the cartridge catching portion 50*a* to ensure that the two gears 55 and 307 properly mesh with each other. To describe this arrangement more specifically, if the gears 55 and 307 collide with each other by the tips of their teeth, the impact from the collision causes the cartridge 40 to slightly oscillate in the radius direction of the rotary device 4. This oscillation of the cartridge 40 eliminates the positional relationship between the gears 55 and 307 which caused the collision. Thereafter, the cartridge 40 comes under the force generated by the resiliency of the springs 53 attached to the rotary device 4, being, therefore, moved into the predetermined position.

Further, should the gear 55 fail to completely disengage from the gear 307 when the cartridge 40 is to be orbitally moved out of the predetermined position so that the next cartridge 40 can be moved into the predetermined position, after the completion of the driving of the first cartridge 40, the meshing between the gears 55 and 307 is cleanly stopped by the above described oscillating mechanism.

Figure 6:
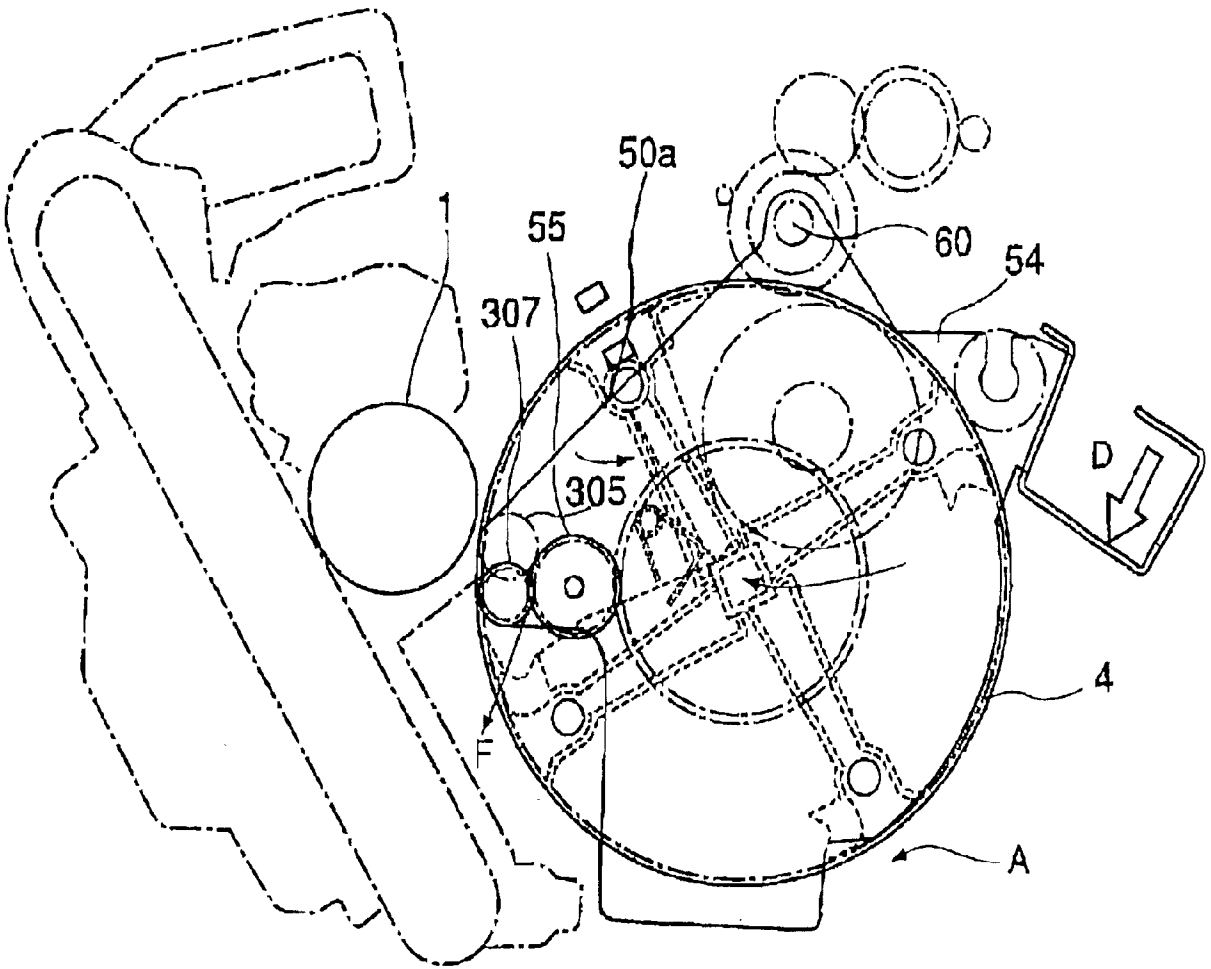
FIG. 6 is a schematic drawing for depicting the development cartridge driving mechanism.

As the driving force is transmitted to the gear 307 from the gear 55, the cartridge 40 is subjected to a force F which acts in the direction indicated by an arrow mark in FIG. 6. This force F causes the cartridge 40 to rotate about the axial line of the cartridge catching portion 50*a* in the counterclockwise direction of the drawing, generating a rotational moment therein. This rotational moment presses the projection 353 upon the catching portion 50*b*, and keeps the projection 353 pressed upon the catching portion 50*b*; in other words, the rotational moment prevents the cartridge 40 from moving out of the predetermined position in the flange 50. Incidentally, this force F resulting from the transmission of the driving force from the gear 55 to the gear 307 belongs to a closed system confined within the rotary device, affecting very little the pressure applied to the photoconductive drum 1 by the cartridge 40.

Structure for Keeping Development Cartridge Pressed Upon Photoconductive Drum In this embodiment, four color development cartridges 40 are held in the rotary device 4. The cartridge 40 in the development position is kept pressed upon the photoconductive drum 1 in the following manner. As described above, the flanges 50 are rotationally supported by the side plates 54, and each side plate 54 is attached by its top portion to a pivotal shaft 60 attached to a side plate, on the corresponding side, of the apparatus main assembly A; in other words, each side plate 54 is pivotally supported by the corresponding side plate of the apparatus main assembly A. Thus, the cartridge 40, the flanges 50, and the side plates 54 pivot together; the rotary device 4 pivots while holding the four cartridges 40, causing one of the cartridge 40 to be pressed upon the photoconductive drum 1 or moving it away from the photoconductive drum 1. This pivoting of the rotary 4 for pressing the cartridge 40 upon the photoconductive drum 1 or moving it away from the photoconductive drum 1 is caused by pushing up the rotary device to stay fixed to the side plate 54 by the rotation of a cam (unillustrated).

Controlling of Rotary Rotation

Referring to FIG. 3, the peripheral portion of each of the flanges 50 constitutes a gear 50*e*, which is an integrally formed part of the flange 50. This gear 50*e* is meshed with a follower gear 59 located at each lengthwise end of the rotary device 4. The two follower gears 59, one at each lengthwise end of the rotary device 4, are connected with a rotational shaft 59*a* so that as one of the flanges 50 rotates, the other will be rotated in the same phase, through the gears 59. With the provision of the above described driving mechanism, it is prevented that one of the flanges 50 becomes twisted when the flanges 50 are rotated, or when the development roller is driven. The rotary driving gear 60*a* for rotating the flange 50 is disposed so that the pivotal axis of the gear 60*a* coincides with that of the side plate 54; in other words, it is attached to the pivotal shaft 60*a*, which is connected to the rotary driving motor 61. Attached to the end of the rotational shaft of the motor 61 is a known encoder 62, which detects the revolution of the motor 61 and controls it. The flange 50 is provided with a flag 57, which projects from the peripheral portion of the flange 50 in the direction perpendicular to the flange 50. As the flange 50 is rotated, the flag 57 rotates with the flange 50, passing a photo-interrupter 58 fixed to the side plate 54.

In this embodiment, control is executed so that the amount of the angle through which the rotary device rotates is detected with reference to the moment the flag 57 shields the photo-interrupter 58; the rotary device is rotated through the predetermined angle from the moment the flag 57 shields the photo-interrupter. The rotational angle of the rotary device is controlled based on the revolution detected by the encoder 62.

Structure of Development Cartridge

Figure 7:
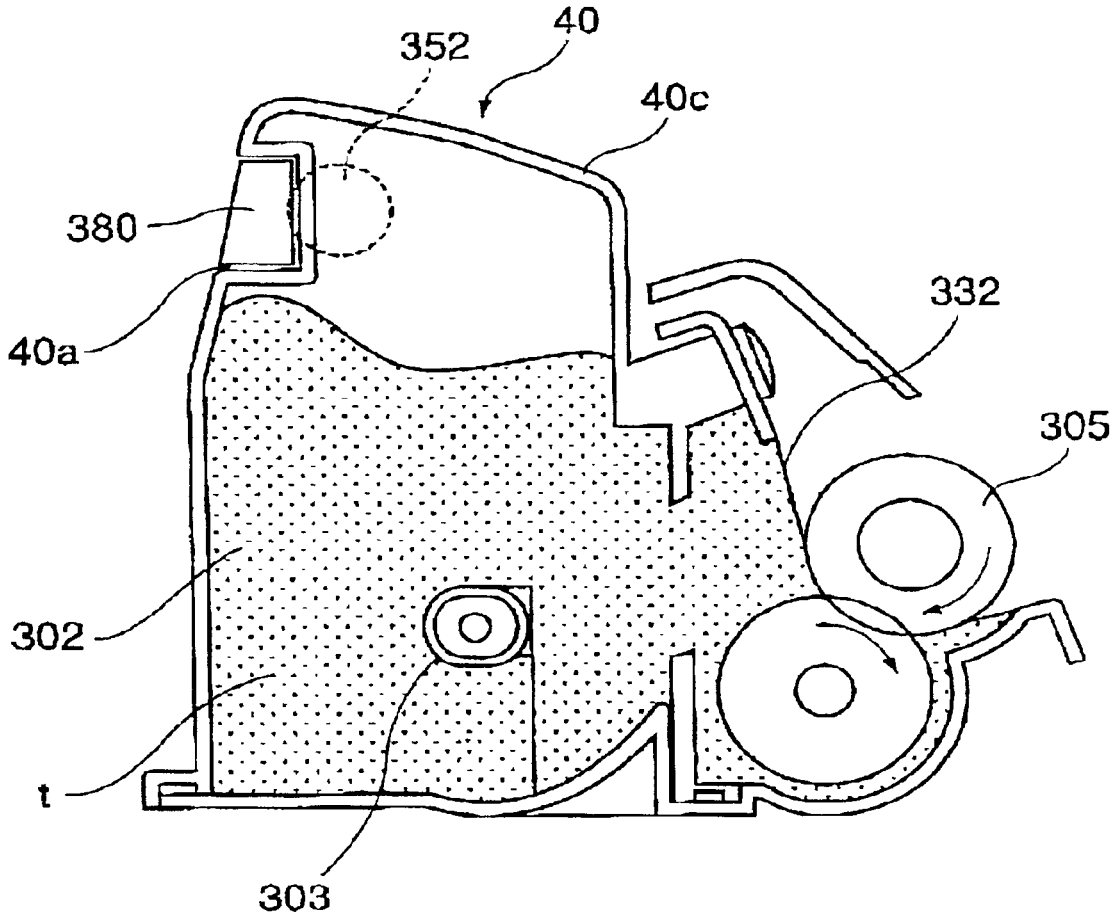
FIG. 7 is a schematic sectional view of the development cartridge, for depicting the structure thereof.

Next, referring to FIG. 7, the development cartridge structure will be described.

The cartridge 40 can be roughly divided into a developer storage portion 302 and a development portion. The developer storage portion 302 is filled with a developer t of a predetermined color. As a stirring means 303 is rotated, a predetermined amount of the developer in the developer storage portion 302 is conveyed to the development portion 301. In the development portion, as a spongy developer supply roller is rotated, the developer is supplied to the peripheral surface of the development roller 305, and the thickness of the developer layer on the development roller 305 is reduced to a predetermined one by a development blade 332, while the developer particles are rubbed against the development blade 332 and development roller 305, being thereby electrically charged. The thin layer of the developer on the development roller 305 is conveyed by the rotation of the development roller 305 to the development portion, in which a predetermined development bias is applied to develop the electrostatic latent image on the photoconductive drum 1. In the development portion, the development roller 305 and developer supply roller are disposed.

The residual developer particles, that is, the developer particles that did not contribute to the development of the latent image on the photoconductive drum 1, and remained on the peripheral surface of the development roller 305, are scraped away by the developer supply roller, while a fresh supply of developer is supplied to the peripheral surface of the development roller 305 by the developer supply roller for the development of the latent image continually formed on the photoconductive drum 1.

Structure of Process Cartridge 5

In this embodiment, the photoconductive drum 1, the intermediary transfer belt 5*a*, and a removed developer box 216 together make up the process cartridge 5 of an integral type. FIG. 8 is a perspective view of the process cartridge 5 as seen from the left side. The process cartridge 5 is made up of two units: a photoconductive drum unit 20 comprising the photoconductive drum 1, and an intermediary transferring member unit 21 comprising the intermediary transfer belt 5*a* and the removed developer toner box 216. The left and right side plates 260 and 261 of the unit 21 extend to cover the left and right end surfaces of the unit 20, holding the unit 20 by its left and right side plates.

Embodiment 2

Figure 13:
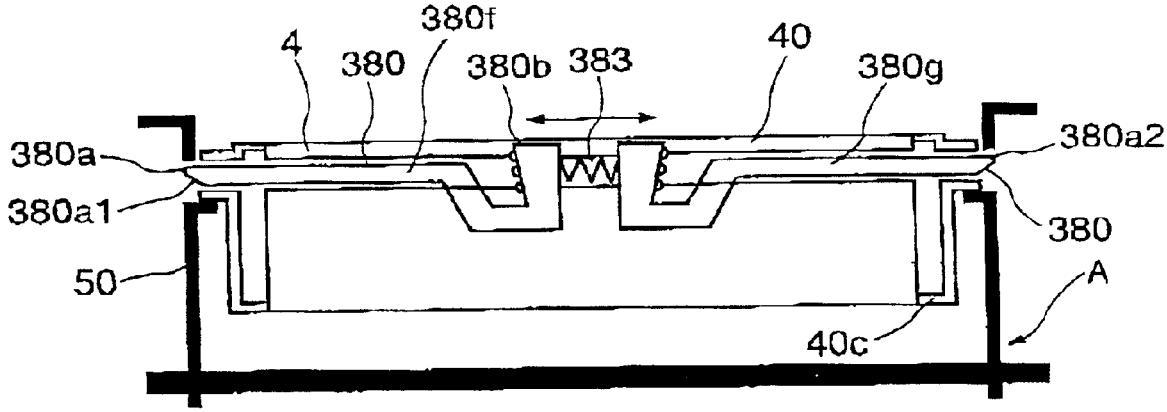
FIG. 13 is a sectional view of a combination of the rotary device and the development cartridge in the second embodiment of the present invention, at a plane parallel to the front panel of an image forming apparatus, for showing how the development cartridge is mounted into the rotary device.

Next, referring to FIG. 13, the second embodiment of a development cartridge and an image forming apparatus, in accordance with the present invention will be described. FIG. 13 is a sectional view of a combination of the rotary device 4 and development cartridge 40 in the second embodiment of the present invention, at a plane parallel to the front panel of an image forming apparatus, for showing how the development cartridge 40 is mounted into the rotary device 4. The portions of the development cartridge 40 and rotary device 4 in this embodiment similar to those in the first embodiment will be given the same reference codes as the reference codes given to the corresponding components in the first embodiment, and their descriptions will be omitted here.

In the above described first embodiment, the handgrip portion 381*a* (381*b*) and sliding portion 380*f* (380*g*) were discrete, and were connected to each other. However, that structural arrangement is not intended to limit the scope of the present invention. For example, the handgrip portion 381*a* (381*b*) and sliding portion 381*f* (381*g*) may be formed as integral parts of a single component, as shown in FIG. 13.

In the drawing, the handgrip-shaped portion 380*b* is an integral part of the sliding member 380*a*. Further, the left and right sliding members 380*f* and 380*g* are kept pressured by a compression spring 383 in the direction to project outward of the cartridge 40 in terms of the lengthwise direction. Therefore, normally, the projections 380*a*1 and 380*a*2, or the outward end portions of the sliding members 380*f* and 380*g*, respectively, are always projecting, and as an operator grasps the handgrip-shaped portion 380*b* (380*a*), both projections 380*a*1 and 380*a*2 are retracted into the frame 40*c*, allowing the cartridge 40 to be mounted into, or dismounted from, the apparatus main assembly 100*a*.

As far as the relationship between the cartridge 40 and flanges 50 during the mounting or dismounting of the cartridge 40 is concerned, the second embodiment is the same as the first embodiment. However, the component count in this embodiment is smaller than that in the first embodiment, making it possible to reduce the development cartridge manufacturing cost.

Embodiment 3

Figure 14:
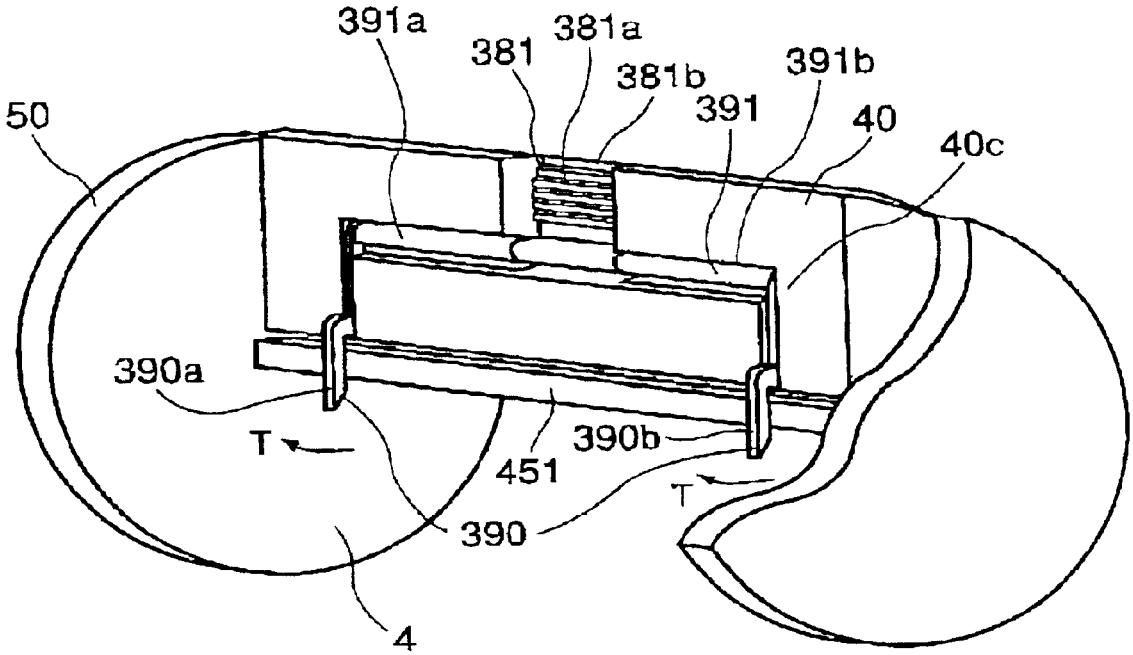
FIG. 14 is a perspective view of the development cartridge and the rotary device, in the third embodiment of the present invention, for depicting the state of the development cartridge after the mounting of the development cartridge into the apparatus main assembly.
Figure 15:
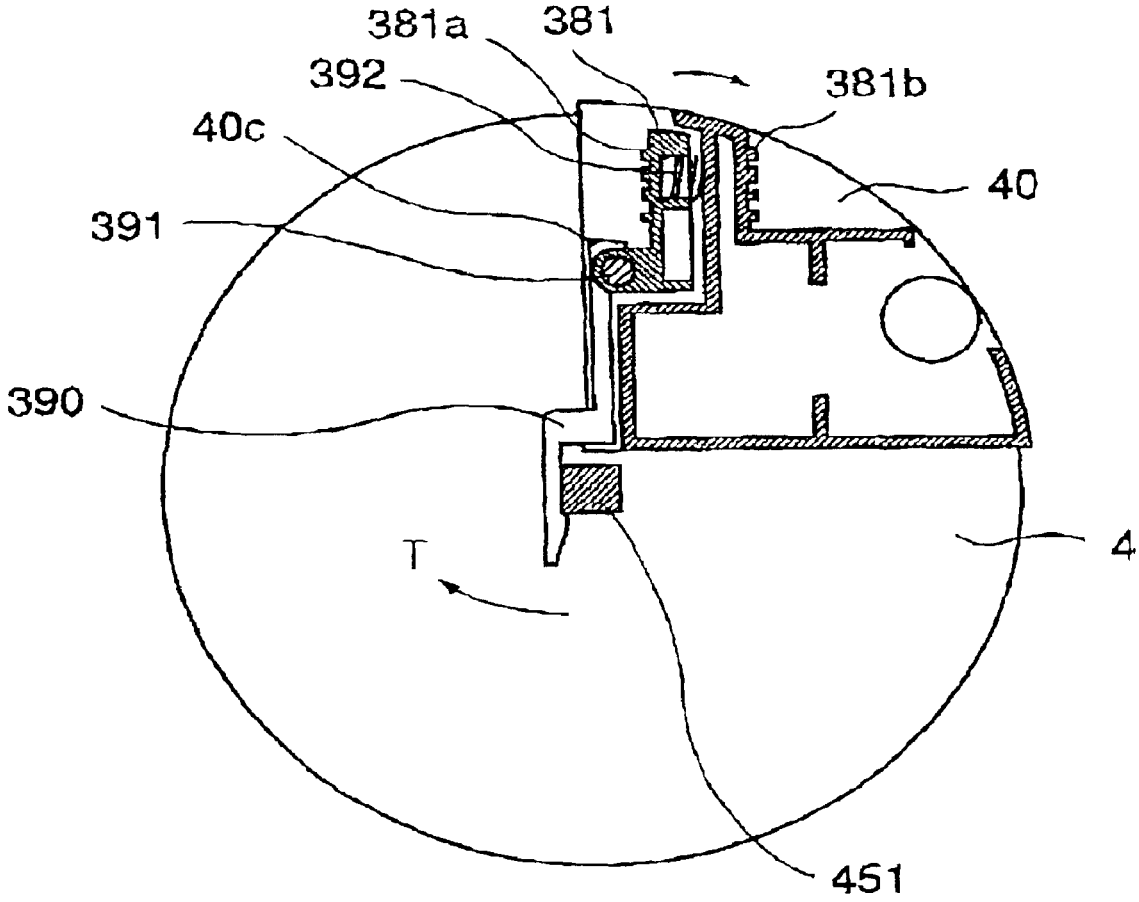
FIG. 15 is an enlarged view of a part of FIG. 14.

Next, referring to FIGS. 14 and 15, the third embodiment of the development cartridge and the image forming apparatus in accordance with the present invention will be described. FIG. 14 is a perspective view of the development cartridge 40 and rotary device 4, in this embodiment of the present invention, as seen from the rear side, for depicting the mounting of the development cartridge 40 into the rotary device 4. FIG. 15 is a schematic sectional view of the development cartridge 40. The portions of the development cartridge 40 and rotary device 4 in this embodiment similar to those in the first embodiment will be given the same reference codes as the reference codes given to the corresponding components in the first embodiment, and their descriptions will be omitted here.

In the first and second embodiments, the structure in which the locking portions 380*a*, as a means for preventing the movement of the development cartridge 40, projecting from the lengthwise ends of the development cartridge 40 were put through the holes 50*d* of the rotary device 4, one for one, was shown. However, that structural arrangement is not intended to limited the scope of the present invention. For example, referring to FIGS. 14 and 15, the rotary device may be provided with a pair of hooks 390, which latch onto the center shaft 451. In this case, the handgrip 381 is connected to the rotational shaft 391, which extends in the lengthwise direction of the cartridge 40, and to the lengthwise ends of which the hooks 390 are attached one for one. Further, the rotational shaft 391 is rotationally attached to the development cartridge frame 40*c*. The handgrip portion 381*a* is kept under the pressure generated by the resiliency of a compression spring 392 in the direction to push the handgrip portion 381*a* away from the handgrip portion 381*b*. Therefore, the hooks 390 remain under the pressure which works in the direction to keep the hooks 390 latched on the center shaft 451.

Thus, as the handgrip 381 is grasped, the hooks 390, one at each lengthwise end, rotate in the direction indicated by an arrow mark T, unlatching themselves from the center shaft 451, and therefore, allowing the cartridge 40 to be removed from the apparatus main assembly A.

In other words, in this embodiment, the hooks 390 (first and second hook 390*a* and 390*b*) constitute the locking portions of the cartridge side, and the center shaft 451 constitutes the locking portion of the main assembly side. Further, the rotational shafts 391 (first and second rotational shafts 391*a* and 391*b*) constitute the releasing members.

The above described embodiments may be summarized as follows.

The cartridge 40 removably mountable in the main assembly A of an electrophotographic image forming apparatus comprises: the developing member (305) for developing the electrostatic latent image formed on the electrophotographic photoconductive member (1); a developer storage portion (302) for storing the developer t used by the developing member (305*a*) for developing the electrostatic latent image; locking portions (380*a* (FIGS. 4, 5, and 9), 390 (FIGS. 14 and 15)) which engage with the locking portions (50*d* (FIGS. 2 and 4), 451 (FIG. 14)) of the apparatus main assembly A in order to prevent the cartridge (40) from becoming dislodged from the apparatus main assembly (A) after the mounting of the cartridge 40 into the apparatus main assembly (A); releasing members (380, 381 (FIGS. 4, 5, and 9), 391 (FIGS. 14 and 15)) for disengaging the locking portions (380*a*, 390) from the locking portions (50*d*, 451) on the apparatus main assembly (A) side when dismounting the cartridge 40 from the apparatus main assembly (A); and the like.

Here, the releasing member is provided with a handgrip (381), which is to be grasped when mounting or dismounting the cartridge 40, into or from, the apparatus main assembly (A), and the locking portions (380*a*, 390) can be disengaged from the locking portions (50*d*, 451) on the apparatus main assembly side, by grasping the handgrip (381).

Further, the handgrip (381) is pivotable about the shafts 381*f* and 381*g*, and the pivoting of the handgrip (381) about the shafts 381*f* and 381*g* causes the releasing member 380 to slide, causing thereby the locking portions (380*a*1, 380*a*2) provided at the lengthwise portion of the releasing member (380), to be disengaged from the locking portion (50*d*) of the apparatus main assembly (A).

Further, the locking portion (380*a*, (380*a*1, 380*a*2)) is located at the lengthwise end of the releasing member (380 (380*f*, 380*g*)), and is caused to project from, or retract into, the frame 40*c* of the cartridge 40, by the movement of the releasing member (380 (380*f*, 380*g*)).

The locking portions (380*a*, (380*a*1, 38O*a*2)) project from, or retract into, the ends of the frame (40*c*), one for one, in terms of the lengthwise direction of the developing member (305).

The axial line of the locking portion (380*a*, (380*a*1, 38O*a*2)) approximately coincides with that of the cartridge positioning portion (352) for positioning the cartridge 40 relative to the apparatus main assembly (A) when mounting the cartridge (40) into the apparatus main assembly (A).

The handgrip (381) comprises: the first handgrip portion (381*a*) which rotates about the first shaft (3810; the second handgrip portion (381*b*) which rotates about the second shaft (381*g*); the first gear (381*d*1) attached to the first handgrip portion (381*a*); the second gear (381*d*2) which is attached to the second handgrip portion (381*b*), and meshed with the first gear (381*d*1); and an elastic member (torsion coil spring 382) positioned between the first handgrip portion (381*a*) and the second handgrip portion (381*b*) so that the force generated by the elasticity of the elastic member acts in the direction to keep the first handgrip portion (381*a*) and the second handgrip portion (381*b*) pressured in the direction to move away from each other.

The releasing member (380) has the first releasing member (380*f*) and the second releasing member (380*g*). The locking portion (380*a*) has the first locking portion (380*a*1) and the second locking portion (380*a*2). One of the lengthwise ends of the first releasing portion (380*f*) has the first locking portion (380*a*1), and the other is connected to the first handgrip portion (381*a*). With the provision of the above structural arrangement, the first releasing portion (380*f*) is caused to move, by the movement of the first handgrip portion (381*a*), causing its first locking portion (380*a*1) to project from, or retract into, the frame 40*c*. Further, one of the lengthwise ends of the second releasing portion (380*g*) has the second locking portion (380*a*2), and the other is connected to the second handgrip portion (381*b*). With the provision of this structural arrangement, the second releasing portion (380*f*) is caused to move, by the movement of the second handgrip portion (381*a*), causing its second locking portion (380*a*2) to project from, or retract into, the frame (40*c*). Here, in terms of the lengthwise direction, the first releasing portion (380*f*) is at one end of the frame 40*c*, which is on one side of the handgrip (381), whereas the second releasing portion (380*g*) is at the other end of the frame (40*c*), which is on the other side of the handgrip (381).

The handgrip (381) and releasing member (380) are on the outward surface of the frame (40*c*), and more specifically, are on the outward surface of the developer storage portion (302).

The rotary device 4 holds four development cartridges 40: a black development cartridge (40Bk), the developer storage portion 302 of which contains black developer; a yellow development cartridge (40Y), the developer storage portion 302 of which contains yellow developer; a magenta development cartridge (40M), the developer storage portion 302 of which contains magenta developer; and a cyan development cartridge (40C), the developer storage portion 302 of which contains cyan developer. The cartridge 40 is removably mounted in the rotary device 4 of the apparatus main assembly A, which rotates, holding the black development cartridge 40Bk, the yellow development cartridge 40Y, the magenta development cartridge 40M, and the cyan development cartridge 40C. The locking portions (380*a*, 390) disengageably engage with the locking portions (50*d*, 451) of the rotary device 4.

The cartridge 40 is a process cartridge comprising the electrophotographic photoconductive member 1.

In the preceding embodiments, the present invention was described with reference to a development cartridge. However, these descriptions were not intended to limit the scope of the present invention. For example, a charging unit cartridge, a cleaning unit cartridge, and the like, may be listed, in addition to a process cartridge, as a cartridge to which the present invention is applicable. Here, the selection of the development cartridge structure does not need to be limited to those in the preceding embodiments, that is, the structures in which the developing member, and the developer storage portion in which the developer used by the developing member for developing an electrostatic latent image is stored, are integrated into a cartridge removably mountable in the apparatus main assembly. For example, the development cartridge does not need to have the developer storage portion, or may have a single or plurality of members other than the above listed ones. Further, a process cartridge is a cartridge in which the electrophotographic photoconductive member and the developing member are integrally disposed, and which is removably mountable in the apparatus main assembly, or a cartridge in which at least one of the charging member and the cleaning member is integrally disposed in addition to the electrophotographic photoconductive member and developing member, and which is removably mountable in the apparatus main assembly.

As described above, according to the present invention, a cartridge could be prevented from unexpectedly dislodging from the apparatus main assembly.

While the invention has been described with reference to the structures disclosed herein, it is not confined to the details set forth, and this application is intended to cover such modifications or changes as may come within the purposes of the improvements or the scope of the following claims.

What is claimed is:

1. A cartridge removably mountable to a main assembly of an electrophotographic image forming apparatus, comprising:

a developing member configured and positioned to develop an electrostatic latent image formed on an electrophotographic photoconductive member;

a developer accommodating portion configured and positioned to accommodate a developer to be used by said developing member to develop the electrostatic latent image;

a locking portion configured and positioned to engage a locking portion of the main assembly of the apparatus to prevent said cartridge from disengaging from the main assembly of the apparatus after mounting of said cartridge;

a grip configured and positioned to be gripped by an operator when said cartridge is mounted to and demounted from the main assembly of the apparatus; and a releasing portion configured and positioned to move said locking portion of said cartridge in interrelation with a movement of said grip which is moved when the operator grips said grip to disengage said cartridge from the main assembly of said apparatus, wherein locking between said locking portion of said cartridge and the locking portion of the main assembly is released by the movement of said locking portion of said cartridge.

2. A cartridge according to claim 1, wherein said grip is rotatable about a shaft, and when said grip is gripped by the operator, said grip rotates about said shaft, causing said releasing portion to slide so that said locking portion of said cartridge, located at an end of said releasing portion, is disengaged from the locking portion of the main assembly of the apparatus.

3. A cartridge according to claim 2, wherein said locking portion of said cartridge is located at an end of said releasing portion, and is caused to project from, or retract into, a frame of said cartridge, by movement of said releasing portion.

4. A cartridge according to claim 3, wherein said locking portion of said cartridge projects from, or retracts into, each of longitudinal end surfaces of the a frame of said cartridge.

5. A cartridge according to claim 4, wherein after the mounting of said cartridge into the main assembly of the apparatus, said locking portion of said cartridge is substantially at a center of a cartridge positioning portion configured and positioned to position said cartridge relative to the main assembly of the apparatus.

6. A cartridge according to claim 4, wherein said grip comprises:

a first grip portion rotatable about a first shaft;

a second grip portion rotatable about a second shaft;

a first gear provided on said first grip portion;

a second gear provided on said second grip portion, and meshed with said first gear; and an elastic member positioned between said first and second grip portions so that the force generated by the elasticity of said elastic member acts in a direction to keep said first and second grip portions pressured away from each other.

7. A cartridge according to claim 6, wherein said releasing portion has a first releasing portion and a second releasing portion, wherein said locking portion of said cartridge has a first locking portion and a second locking portion, wherein one of the longitudinal ends of said first releasing portion has said first locking portion, and the other longitudinal end of said first releasing portion is connected to said first grip portion, wherein said first releasing portion is movable by movement of said first grip portion, thus causing said first locking portion to project from, or retract into, a frame of said cartridge, wherein one of the longitudinal ends of said second releasing portion has said second locking portion, and the other longitudinal end of said second releasing portion is connected to said second grip portion, wherein said second releasing portion is movable by movement of said second grip portion, thus causing said second locking portion to project from, or retract into, the frame; and wherein said first releasing portion is at one longitudinal end of the frame, which is on one side of said grip, whereas said second releasing portion is at the other end of the frame, which is on the other side of said grip.

8. A cartridge according to claim 7, wherein said grip and said releasing portion are on an outside of the frame of said cartridge and opposed to said developer accommodating portion.

9. A cartridge according to claim 1, wherein said cartridge is a black developing cartridge accommodating a black developer, a yellow developing cartridge accommodating a yellow developer, a magenta developing cartridge accommodating a magenta developer, or a cyan developing cartridge accommodating a cyan developer, wherein said cartridges are detachably mountable in a rotary member of the main assembly of the apparatus, which is rotatably holding said black developing cartridge, said yellow developing cartridge, said magenta developing cartridge, and said cyan developing cartridge, and said locking portion of each of said cartridges disengageably engages with a locking portion of the rotary member.

10. A cartridge according to claim 1, wherein said cartridge is a process cartridge comprising an electrophotographic photoconductive member.

11. A cartridge according to claim 3, 4, or 5, wherein said grip comprises:

a first grip portion rotatable about a first shaft;

a second grip portion rotatable about a second shaft;

a first gear provided on said first grip portion;

a second gear provided on said second grip portion, and meshed with said first gear; and an elastic member positioned between said first and second grip portions so that the force generated by the elasticity of said elastic member acts in a direction to keep said first and second grip portions pressured away from each other.

12. A cartridge according to claim 11, wherein said releasing portion has a first releasing portion and a second releasing portion, wherein said locking portion of said cartridge has a first locking portion and a second locking portion, wherein one of the longitudinal ends of said first releasing portion has said first locking portion, and the other longitudinal end of said first releasing portion is connected to said first grip portion, wherein said first releasing portion is movable by movement of said first grip portion, thus causing said first locking portion to project from, or retract into, the frame of said cartridge, wherein one of the longitudinal ends of said second releasing portion has said second locking portion, and the other longitudinal end of said second releasing portion is connected to said second grip portion, wherein said second releasing portion is movable by movement of said second grip portion, thus causing said second locking portion to project from, or retract into, the frame, and wherein said first releasing portion is at one longitudinal end of the frame, which is on one side of said grip, whereas said second releasing portion is at the other end of the frame, which is on the other side of said grip.

13. A cartridge according to claim 12, wherein said grip and said releasing portion are on an outside of the frame of said cartridge and opposed to said developer accommodating portion.

14. An electrophotographic image forming apparatus to a main assembly of which a cartridge is detachably mountable, and which is for forming an image on a recording medium, said apparatus comprising:

(I) a cartridge mounting portion configured and positioned to detachably mount the cartridge, the cartridge including:

a developing member configured and positioned to develop an electrostatic latent image formed on an electrophotographic photoconductive member;

a developer accommodating portion configured and positioned to accommodate a developer to be used by the developing member to develop the electrostatic latent image;

a locking portion configured and positioned to engage a locking portion of the main assembly of said apparatus to prevent the cartridge from disengaging from the apparatus main assembly of said apparatus after mounting of the cartridge;

a grip configured and positioned to be gripped by an operator when the cartridge is mounted to the main assembly of said apparatus; and a releasing portion configured and positioned to move the locking portion of the cartridge in interrelation with a movement of the grip which is moved when the operator grips the grip to disengage the cartridge from the main assembly of said apparatus, wherein locking between the locking portion of the cartridge and the locking portion of the main assembly is released by the movement of the locking portion of the cartridge; and (ii) conveying means for conveying the recording medium.

15. An electrophotographic image forming apparatus according to claim 14, wherein said apparatus further comprises a rotatable rotary device, wherein said cartridge mounting portion is in said rotatable rotary device, which comprises:

a first mounting portion, to which a black developing cartridge accommodating a black developer, is mountable;

a second mounting portion, to which a yellow developing cartridge accommodating a yellow developer, is mountable;

a third mounting portion, to which a magenta developing cartridge accommodating a magenta developer, is mountable; and a fourth mounting portion, to which a cyan developing cartridge accommodating a cyan developer, is mountable, wherein said rotary device is rotatable to sequentially place the developing cartridges on said rotary device at a developing position where a developing cartridge opposes the electrophotographic photoconductive member in the main assembly of said apparatus, and wherein said rotary device is provided with a cartridge locking portion.

16. A cartridge removably mountable to a main assembly of an electrophotographic image forming apparatus, comprising:

a developing member configured and positioned to develop an electrostatic latent image formed on an electrophotographic photoconductive member, a developer accommodating portion configured and positioned to accommodate a developer to be used by said developing member to develop the electrostatic latent image;

a locking portion configured and positioned to engage a locking portion of the main assembly of the apparatus to prevent said cartridge from disengaging from the main assembly of the apparatus after mounting of said cartridge;

a grip configured and positioned to be gripped by an operator when said cartridge is mounted to the main assembly of the apparatus; and a releasing portion configured and positioned to move said locking portion of said cartridge in interrelation with a movement of said grip which is moved when the operator grips said grip to disengage said cartridge from the main assembly of the apparatus, wherein locking between said locking portion of said cartridge and the locking portion of the main assembly is released by the movement of said locking portion of said cartridge, and wherein after the mounting of said cartridge into the main assembly of the apparatus, said locking portion of said cartridge is substantially at a center of a cartridge positioning portion configured and positioned to position said cartridge relative to the main assembly of the apparatus.

17. A cartridge according to claim 16, wherein said grip is rotatable about a shaft, and when said grip is gripped by the operator, said grip rotates about said shaft, causing said releasing portion to slide so that said locking portion of said cartridge, located at an end of said releasing portion, is disengaged from the locking portion of the main assembly of the apparatus.

18. A cartridge according to claim 17, wherein said grip comprises:

a first grip portion rotatable about a first shaft;

a second grip portion rotatable about a second shaft;

a first gear provided on said first grip portion;

a second gear provided on said second grip portion, and meshed with said first gear; and an elastic member positioned between said first and second grip portions so that the force generated by the elasticity of said elastic member acts in a direction to keep said first and second grip portions pressured away from each other.

19. A cartridge removably mountable to a main assembly of an electrophotographic image forming apparatus, comprising:

a developing member configured and positioned to develop an electrostatic latent image formed on an electrophotographic photoconductive member;

a developer accommodating portion configured and positioned to accommodate a developer to be used by said developing member to develop the electrostatic latent image;

a locking portion configured and positioned to engage a locking portion of the main assembly of the apparatus to prevent said cartridge from disengaging from the main assembly of the apparatus after mounting of said cartridge;

a grip configured and positioned to be gripped by an operator when said cartridge is mounted to the main assembly of the apparatus; and a releasing portion configured and positioned to move said locking portion of said cartridge in interrelation with a movement of said grip which is moved when the operator grips said grip to disengage said cartridge from the main assembly of the apparatus, wherein locking between said locking portion of said cartridge and the locking portion of the main assembly is released by the movement of said locking portion of said cartridge, wherein said grip comprises:

a first grip portion rotatable about a first shaft;

a second grip portion rotatable about a second shaft;

a first gear provided on said first grip portion;

a second gear provided on said second grip portion, and meshed with said first gear; and an elastic member positioned between said first and second grip portions so that the force generated by the elasticity of said elastic member acts in a direction to keep said first and second grip portions pressured away from each other, wherein said releasing portion has a first releasing portion and a second releasing portion, wherein said locking portion of the cartridge has a first locking portion and a second locking portion, wherein one of the longitudinal ends of said first releasing portion has said first locking portion, and the other longitudinal end of said first releasing portion is connected to said first grip portion, wherein said first releasing portion is movable by movement of said first grip portion, thus causing said first locking portion to project from, or retract into, a frame of said cartridge, wherein one of the longitudinal ends of said second releasing portion has said second locking portion, and the other longitudinal end of said second releasing portion is connected to said second grip portion, wherein said second releasing portion is movable by movement of said second grip portion, thus causing said second locking portion to project from, or retract into, the frame, and wherein said first releasing portion is at one longitudinal end of the frame, which is on one side of said grip, whereas said second releasing portion is at the other end of the frame, which is on the other side of said grip.

20. A cartridge according to claim 19, wherein said grip is rotatable about a shaft, and when said grip is gripped by the operator, said grip rotates about said shaft, causing said releasing portion to slide so that said locking portion of said cartridge, located at an end of said releasing portion, is disengaged from the locking portion of the main assembly of the apparatus.

21. An electrophotographic image forming apparatus to a main assembly of which a cartridge is detachably mountable, and which is for forming an image on a recording medium, said apparatus comprising:

(I) a cartridge mounting portion configured and positioned to detachably mount the cartridge, the cartridge including:

a developing member configured and positioned to develop an electrostatic latent image formed on an electrophotographic photoconductive member;

a developer accommodating portion configured and positioned to accommodate a developer to be used by the developing member to develop the electrostatic latent image;

a locking portion configured and positioned to engage a locking portion of the main assembly of said apparatus to prevent the cartridge from disengaging from the main assembly of said apparatus after mounting of the cartridge;

a grip configured and positioned to be gripped by an operator when the cartridge is mounted to the main assembly of said apparatus; and a releasing portion configured and positioned to move the locking portion of the cartridge in interrelation with a movement of the grip which is moved when the operator grips the grip to disengage the cartridge from the main assembly of said apparatus, wherein locking between the locking portion of the cartridge and the locking portion of the main assembly is released by the movement of the locking portion of the cartridge, and wherein after the mounting of the cartridge into the main assembly of said apparatus, the locking portion of the cartridge is substantially at a center of a cartridge positioning portion configured and positioned to position the cartridge relative to the main assembly of said apparatus, and (ii) conveying means for conveying the recording medium.

22. An electrophotographic image forming apparatus to a main assembly of which a cartridge is detachably mountable, and which is for forming an image on a recording medium, said apparatus comprising:

(I) a cartridge mounting portion configured and positioned to detachably mount the cartridge, the cartridge including:

a developing member configured and positioned to develop an electrostatic latent image formed on an electrophotographic photoconductive member;

a developer accommodating portion configured and positioned to accommodate a developer to be used by the developing member to develop the electrostatic latent image;

a locking portion configured and positioned to engage a locking portion of the main assembly of said apparatus to prevent the cartridge from disengaging from the main assembly of said apparatus after mounting of the cartridge;

a grip configured and positioned to be gripped by an operator when the cartridge is mounted to the main assembly of said apparatus; and a releasing portion configured and positioned to move the locking portion of the cartridge in interrelation with a movement of the grip which is moved when the operator grips the grip to disengage the cartridge from the main assembly of said apparatus, wherein locking between the locking portion of the cartridge and the locking portion of the main assembly is released by the movement of the locking portion of the cartridge, wherein the grip comprises:

a first grip portion rotatable about a first shaft;

a second grip portion rotatable about a second shaft;

a first gear provided on the first grip portion;

a second gear provided on the second grip portion, and meshed with the first gear; and an elastic member positioned between the first and second grip portions so that the force generated by the elasticity of the elastic member acts in a direction to keep the first and second grip portions pressured away from each other, wherein the releasing portion has a first releasing portion and a second releasing portion, wherein the locking portion of the cartridge has a first locking portion and a second locking portion, wherein one of the longitudinal ends of the first releasing portion has the first locking portion, and the other longitudinal end of the first releasing portion is connected to the first grip portion, wherein the first releasing portion is movable by movement of the first grip portion, thus causing the first locking portion to project from, or retract into, a frame of the cartridge, wherein one of the longitudinal ends of the second releasing portion has the second locking portions, and the other longitudinal end of the second releasing portion is connected to the second grip portion, wherein the second releasing portion is movable by movement of the second grip portion, thus causing the second locking portion to project from, or retract into, the frame, and wherein the first releasing portion is at one longitudinal end of the frame, which is on one side of the grip, whereas the second releasing portion is at the other end of the frame, which is on the other side of the grip, and (ii)conveying means for conveying the recording medium.

* * * * *

UNITED STATES PATENT AND TRADEMARK OFFICE

CERTIFICATE OF CORRECTION

PATENT NO. : 6,834,173 B2
DATED : December 21, 2004
INVENTOR(S) : Koji Yamaguchi et al.

It is certified that error appears in the above-identified patent and that said Letters Patent is hereby corrected as shown below:

Column 7,
Line 47, “381 a” should read -- 381a --.

Column 14,
Line 2, “38Oa2))” should read -- 380a2)) --.
Line 7, “shaft (3810;” should read -- shaft (381f); --.

Column 16,
Line 7, “a” should be deleted.

Column 17,
Line 53, “(I)” should read -- (i) --.

Column 20,
Lines 25-31, should be deleted.
Line 36, “(I)” should read -- (i) --.

Column 21,
Line 9, “(I)” should read -- (i) --.

Column 22,
Line 22, “portions,” should read -- portion, --.

Signed and Sealed this

Twenty-fourth Day of May, 2005

JON W. DUDAS
*Director of the United States Patent and Trademark Office*